US010232211B1

(12) United States Patent
Koch

(10) Patent No.: US 10,232,211 B1
(45) Date of Patent: Mar. 19, 2019

(54) EXERCISE APPARATUS

(71) Applicant: Kregg Alan Koch, Manhattan Beach, CA (US)

(72) Inventor: Kregg Alan Koch, Manhattan Beach, CA (US)

( * ) Notice: Subject to any disclaimer, the term of this patent is extended or adjusted under 35 U.S.C. 154(b) by 95 days.

(21) Appl. No.: 15/213,380

(22) Filed: Jul. 18, 2016

Related U.S. Application Data

(60) Provisional application No. 62/193,397, filed on Jul. 16, 2015.

(51) Int. Cl.

| | |
|---|---|
| ***A63B 21/00*** | (2006.01) |
| ***A63B 21/04*** | (2006.01) |
| ***A63B 22/04*** | (2006.01) |
| ***A63B 22/06*** | (2006.01) |
| ***A63B 23/035*** | (2006.01) |
| ***A63B 23/04*** | (2006.01) |
| ***A63B 23/12*** | (2006.01) |

(52) U.S. Cl.
CPC ..... *A63B 21/0442* (2013.01); *A63B 21/4035* (2015.10); *A63B 22/04* (2013.01); *A63B 22/0605* (2013.01); *A63B 22/0664* (2013.01); *A63B 23/03525* (2013.01); *A63B 23/03591* (2013.01); *A63B 23/0476* (2013.01); *A63B 23/1209* (2013.01)

(58) Field of Classification Search
CPC ... A63B 21/02–21/0557; A63B 21/145; A63B 22/06–22/0964; A63B 22/0012
See application file for complete search history.

(56) References Cited

U.S. PATENT DOCUMENTS

| | | | |
|---|---|---|---|
| 972,284 | A | 10/1910 | Storey |
| 3,345,067 | A | 10/1967 | Smith |
| 3,567,219 | A | 3/1971 | Foster |
| 3,587,319 | A | 6/1971 | Andrews |
| 3,802,701 | A | 4/1974 | Good |
| 3,807,727 | A | 4/1974 | Ferguson |
| 4,063,727 | A | 12/1977 | Hall |
| 4,332,399 | A | 6/1982 | Kepple |
| 4,494,662 | A | 1/1985 | Clymer |
| 4,535,991 | A | 8/1985 | Boatright |
| 4,620,704 | A | 11/1986 | Shifferaw |
| 4,625,963 | A | 12/1986 | Lancellotti |
| 4,725,057 | A | 2/1988 | Shifferaw |

(Continued)

FOREIGN PATENT DOCUMENTS

| | | |
|---|---|---|
| WO | WO 82/00100 | 1/1982 |

*Primary Examiner* — Jennifer M Deichl
(74) *Attorney, Agent, or Firm* — Proven Patents; Kregg A. Koch

(57) ABSTRACT

An exercise system comprising one or more resilient members and a secondary exercise device. The secondary exercise device can be in exercise bike, elliptical machine, stepper, treadmill, or any other suitable cardiovascular or exercise device. One or more resilient member support elements can be supported by a base member which can be separate from or integral with the frame or support members of the secondary exercise device. In this configuration, a user can exercise his or her muscles using the resilient members while simultaneously operating the secondary exercise device. Additional exercise stations comprising the resilient members can be formed around the secondary exercise device.

20 Claims, 21 Drawing Sheets

(56) References Cited

U.S. PATENT DOCUMENTS

| | | | | |
|---|---|---|---|---|
| 4,822,039 | A | 4/1989 | Gonzales et al. | |
| 5,013,034 | A | 5/1991 | March et al. | |
| 5,064,190 | A | 11/1991 | Holt | |
| 5,123,886 | A | 6/1992 | Cook | |
| 5,403,256 | A | 4/1995 | Squires | |
| 5,522,783 | A | 6/1996 | Gordon | |
| 5,524,893 | A | 6/1996 | McGinnis et al. | |
| 5,755,649 | A | 5/1998 | Bimby | |
| 5,759,139 | A | 6/1998 | Wright | |
| 5,860,897 | A | 1/1999 | Gilbert et al. | |
| 5,913,754 | A | 6/1999 | Lochbaum | |
| 5,971,891 | A | 10/1999 | Humphrey | |
| 6,406,410 | B1 | 6/2002 | Lochbaum | |
| 6,416,447 | B1 | 7/2002 | Harmon | |
| 6,676,579 | B1 * | 1/2004 | Lin ..... | A63B 22/0012 482/146 |
| 6,872,174 | B2 | 3/2005 | Benach | |
| 6,964,636 | B2 | 11/2005 | Verheem et al. | |
| 7,041,041 | B1 | 5/2006 | Evans | |
| 7,309,303 | B1 | 12/2007 | Proctor | |
| 8,500,612 | B2 | 8/2013 | Koch et al. | |
| 2003/0186792 | A1 | 10/2003 | Keeler | |
| 2005/0079962 | A1 | 4/2005 | Brown, Jr. | |
| 2005/0209071 | A1 | 9/2005 | Liang | |
| 2005/0233877 | A1 | 10/2005 | Lin | |

* cited by examiner

EXERCISE APPARATUS

PRIORITY INFORMATION AND INCORPORATION BY REFERENCE

This application claims priority benefit, under the appropriate legal basis, including without limitation, 35 U.S.C. § 119(e), of Provisional Application 62/193,397 filed Jul. 16, 2015, which application is hereby incorporated by reference as if fully set forth herein. Additionally, U.S. Pat. No. 8,500,612 (U.S. patent application Ser. No. 13/018,307, titled "Exercise Apparatus," issued as on Aug. 6, 2013) and U.S. Pat. No. 7,704,199 (U.S. patent application Ser. No. 11/533,766, issued as on Apr. 27, 2010) are hereby incorporated by reference as if fully set forth herein.

TECHNICAL FIELD

This disclosure relates to the field of fitness or exercise equipment.

DESCRIPTION OF THE RELATED ART

Without limitations, in general, the exercise apparatus or device of this disclosure relates to the use of deflectable resilient members for exercising the muscles of one's body. There are no known exercises devices available on the market utilizing resistance members to provide resistance training in the arrangements and having the capabilities of the systems described herein.

SUMMARY OF SOME EMBODIMENTS

The exercise apparatus of the present disclosure is not limited to the following description. The following is meant merely as a brief summary of the general features of the exercise apparatus of the present disclosure. A more complete written description is listed below. The exercise apparatus of the present disclosure comprises a base member that can be free standing or mounted to any horizontal, vertical, or angled surface. Resilient members, such as rods of plastic, can be removably or permanently mounted in a cantilevered fashion to the base member at any of a wide range of locations or angular orientations, so that one end of the resilient member is fixed to the base member and the other end of the resilient member is unrestrained. The user can perform a wide range of strength and physical therapy exercises for many if not all of the various muscle groups of the body by grasping the somewhat stiff resilient members in his or her hands and exerting a force on the unrestrained portion of the resilient member in any direction that is generally transverse to the longitudinal centerline of the resilient member, causing the resilient member to bend in flexure. The resilient members are preferably designed to enable multi-directional resistance and can be used independently or simultaneously, permitting the user to exercise multiple different muscles simultaneously. The apparatus is preferably designed so that it can support the user in a free standing, kneeling, or sitting position, or any other position that will maximize core strength training in a manner not generally feasible with conventional devices comprising flat benches, walls, or other similar stabilizing structures. Further, the exercise apparatus of the present disclosure can be readily configured for home use with little instruction to enable the user to exercise and strengthen virtually every muscle group and/or joint of the body and at any widely variable level of resistance by changing the orientation, location, and/or stiffness of the resilient members.

Some embodiments described herein are directed to exercise devices and resilient members for exercising the muscles of one's body. However, it will be appreciated that the exercise devices and resilient members may have application to other fields. In some embodiments, a resilient member for fitness related exercise can be provided that can comprise one or more stiffening members (which can be axially resilient or axially rigid but bendable), a first member, and a second member. As used in this document, any reference to "some embodiments" or to any embodiment or component disclosed "herein" is meant to refer to any embodiments or components set forth explicitly or implicitly herein, and/or any embodiments or components incorporated by reference herein. In some embodiments, the first member can be positioned at a first portion of the resilient member and configured to be supported by a base member, the first member further being configured to support a first portion of the one or more stiffening members such that the one or more stiffening members extend therefrom in a cantilevered disposition. Further, in some embodiments, the second member can be spaced apart from the first member and configured to interact with a second portion of the one or more stiffening members such that, when a user exerts a force on the second member, at least the second portion of each of the one or more stiffening members deflects and a resistance can be provided.

In some embodiments, a resilient member for fitness related exercise can be provided that can comprise a first member configured to be supported by a base member and comprising a plurality of axial openings, a second member spaced apart from the first member and comprising a plurality of axial openings, and one or more stiffening members, wherein the first portion of the one or more stiffening members can be positioned in one or more of the plurality of axial openings in the first member such that the one or more stiffening members extend therefrom in a cantilevered disposition. Further, in some embodiments, the second portion of the one or more stiffening members can be positioned in one or more of the plurality of axial openings in the second member such that, when a user exerts a force on the second member, at least the second portion of each of the one or more stiffening members deflects and a resistance force can be provided.

In some embodiments, a resilient member for fitness related exercise is provided comprising a stiffening member defining a first portion and a second portion, a first member configured to be secured to a base member, comprising a first axial opening positioned near the axial center of the first member and plurality of additional axial openings being spaced apart from the first axial opening of the first member, a second member comprising a first axial opening positioned near the axial center of the second member and plurality of additional axial openings being spaced apart from the first axial opening of the second member, wherein the first portion of the stiffening member can be supported by the first axial opening of the first member so as to extend therefrom in a cantilevered disposition, the second portion of the stiffening member can be positioned in the first axial opening of the second member such that, when a user exerts a force on the second member, at least the second portion of the stiffening member deflects and a resistance force can be provided.

In some embodiments, a resilient member for fitness related exercise can be provided comprising a first stiffening member comprising a first portion and a second portion, a first member positioned at a first portion of the resilient member and configured to be supported by a base member, and a second member, wherein the first member can be further configured to support at least the first portion of the first stiffening member such that the first stiffening member extends therefrom in a cantilevered disposition, the second member can be configured to interact with the second portion of the first stiffening member such that, when a user exerts a force on the second member, at least a second portion of the first resilient member deflects and a resistance force can be provided.

In some embodiments, a resilient member for fitness related exercise is provided comprising one or more stiffening members, each having a first end portion and a second end portion, a first member positioned at a first portion of the resilient member and configured to be secured to a base member and to support the one or more stiffening members, and a second member configured to support the second end portion of each the one or more stiffening members such that, when a lateral force can be exerted on the second member, the second end portion of each of the one or more stiffening members deflects.

In some embodiments, a method of exercising the muscles of one's body is provided, comprising providing a resilient member, supporting the resilient member in a cantilevered disposition so that the first portion of the resilient member can be substantially prevented from pivoting relative to the exercise device base member, exerting a force on the resilient member so as to deflect at least a portion of the resilient member and effect an exercising of one or more muscles in the user's body, and varying the resistance force provided by the resilient member by adding or removing at least one additional stiffening member to the resilient member, wherein each of the at least one additional stiffening members supported by the resilient member can be supported by the resilient member such that at least a first portion of the at least one additional stiffening member extends from the first member in a cantilevered disposition. In some embodiments, the resilient member can comprise at least one stiffening member, a first member positioned at a first portion of the resilient member and configured to be supported by a base member in a cantilevered disposition so that the first portion of the resilient member can be substantially prevented from pivoting relative to the exercise device base member, the first member further configured to support a first portion of the at least one stiffening member such that the at least one stiffening member extend therefrom in a cantilevered disposition, and a second member configured to at least radially support at least a second portion of the at least one stiffening member such that, when a user exerts a force on the second member, at least the second portion of each of the at least one stiffening member deflects from the longitudinal axis of the relaxed position of each of the at least one stiffening member and a resistance is provided. In some embodiments, the resilient member can comprise at least one stiffening member that can be at least axially supported by the first and second members.

In some embodiments, a device for exercising the muscles in one's body is provided that can comprise a base and a resilient member, wherein the base can be configured to provide one or more removable supports for an end portion of the resilient member such that the resilient member extends therefrom in a cantilevered disposition, and the resilient member comprises one or more stiffening members that can be, but are not required to be axially rigid (as with any embodiments described herein), a first member positioned at a first portion of the resilient member and configured to be supported by the base member and to provide a support for the one or more stiffening members such that the one or more stiffening members extend therefrom in a cantilevered disposition, and a second member supported by at least one of the one or more stiffening members and configured such that, when a user exerts a force on the second member, at least a portion of each of the one or more stiffening members deflects and a resistance force can be provided.

The following arrangements describe some embodiments of the present disclosure.

Arrangement 1: An exercise device, comprising:

a first base element supported by a support structure;

a first set of connection interfaces supported by the first base element, the first set of connection interfaces comprising a first connection interface having a first axial centerline and positioned at a first angular orientation and a second connection interface having a second axial centerline and positioned at a second angular orientation that is different than the first angular orientation;

a pair of independently deflectable resilient members each configured to produce a resistance force when a user exerts a force thereon so as to deflect at least a portion of each resilient member from the longitudinal axis of the relaxed position of each resilient member; and a supplemental exercise element configured to provide an additional mode of exercise separate and independent from the resilient members, the supplemental exercise element being usable simultaneously with the resilient members;

wherein: each connection interface is configured to provide a removable support for each resilient member so as to support each resilient member in a cantilever disposition; and the first base element is configured such that a user exercises while standing, kneeling, sitting, lying, jogging, running, pedaling, or otherwise exercising on the supplemental exercise element.

Arrangement 2: The device of the first arrangement, wherein the first base element has an arcuate shaped top surface.

Arrangement 3: The device of any one of the previous arrangements, wherein the first base element has an arcuate shaped top surface and wherein the connection interfaces comprise holes that are approximately perpendicular to the top surface.

Arrangement 4: The device of any one of the previous arrangements, wherein the supplemental exercise element comprises at least one of a rotating platform, a vibration platform, a spinning platform, a treadmill, set of pedals, crank, and resistance mechanism configured to provide resistance to the pedals and crank, a set of pedals configured to move in a circular or an elliptical pathway, a stationary bicycle, a spin bicycle, elliptical machine, a slide board, step climber, stair climber, recumbent exercise device, recumbent stepper, recumbent elliptical machine, and a recumbent bicycle.

Arrangement 5: The device of any one of the previous arrangements, wherein:

the pair of resilient members comprise a first resilient member configured to be supported by any one of the connection interfaces in a cantilever disposition; and a second resilient member configured to be supported by any one of the connection interfaces in a cantilever disposition;

wherein:

the first and second resilient members are configured to produce a resistance force when a user exerts a force thereon so as to bend at least a portion of the resilient member, effecting an exercising of one or more muscles in the user's body;

the first resilient member is stiffer than the second resilient member such that a greater force is required to bend at least a portion of the first resilient member as compared to the second resilient member; and each connection interface is configured to support either one of the first and second resilient members.

Arrangement 6: The device of any one of the previous arrangements, comprising:

the pair of resilient members comprise a first resilient member configured to be supported by any one of the connection interfaces in a cantilever disposition; and a second resilient member configured to be supported by any one of the connection interfaces in a cantilever disposition;

wherein:

the first and second resilient members are configured to produce a resistance force when a user exerts a force thereon so as to bend at least a portion of the resilient member, effecting an exercising of one or more muscles in the user's body;

the first resilient member has a cross-sectional size that is different than the cross-sectional size of the second resilient member; and each connection interface is configured to support either one of the first and second resilient members.

Arrangement 7: The device of any one of the previous arrangements, wherein the first base element is supported by a frame structure that is supported by the support structure.

Arrangement 8: The device of the previous arrangement, wherein the support structure is a ground or a wall surface.

Arrangement 9: The device of any one of the previous arrangements, wherein the first base element has a generally arcuate shape.

Arrangement 10: The device of any one of the previous arrangements, wherein one or more of the connection interfaces are openings formed generally perpendicular to an arcuate surface of the first base element.

Arrangement 11: The device of any one of the previous arrangements, comprising a first base element and a second base element, wherein the first and second base elements comprise connection interfaces that are configured to support each of the resilient members in between 3 and 5 different angular orientations.

Arrangement 12: The device of any one of the previous arrangements, comprising a first base element and a second base element, wherein the first and second base elements comprise connection interfaces that are configured to support each of the resilient members in between 5 and 10 different angular orientations.

Arrangement 13: The device of any one of the previous arrangements, further comprising a second base element supported by the support structure, the second base element comprising a second set of connection interfaces supported by the second base element, the second set of connection interfaces comprising a third connection interface having a third axial centerline and positioned at a third angular orientation and a fourth connection interface having a fourth axial centerline and positioned at a fourth angular orientation that is different than the third angular orientation.

Arrangement 14: The device of Arrangement 13, wherein:

the first axial centerline and the second axial centerline define a first plane;

the third axial centerline and the fourth axial centerline define a second plane; and the first plane is not coplanar with the second plane.

Arrangement 15: The device of Arrangement 13, wherein the device is configured such that the first set of connection interfaces can be used by a first user and the second set of connection interfaces can be simultaneously used by a second user.

Arrangement 16: The device of any one of the previous arrangements, wherein the support structure supports and is coupled with the first base element and one or more components of the supplemental exercise element.

Arrangement 17: An exercise device, comprising:

a first base element supported by a support surface;

a second base element supported by a support surface;

a first set of connection interfaces supported by the first base element, the first set of connection interfaces comprising a first connection interface having a first axial centerline and positioned at a first angular orientation and a second connection interface having a second axial centerline and positioned at a second angular orientation that is different than the first angular orientation;

the second base element comprising a second set of connection interfaces supported by the second base element, the second set of connection interfaces comprising a third connection interface having a third axial centerline and positioned at a third angular orientation and a fourth connection interface having a fourth axial centerline and positioned at a fourth angular orientation that is different than the third angular orientation;

a plurality of independently deflectable resilient members each configured to produce a resistance force when a user exerts a force thereon so as to deflect at least a portion of each resilient member from the longitudinal axis of the relaxed position of each resilient member; and a supplemental exercise element configured to provide an additional mode of exercise separate and independent from the resilient members, the supplemental exercise element being usable simultaneously with the resilient members;

wherein:

each connection interface is configured to provide a removable support for each resilient member so as to support each resilient member in a cantilever disposition;

the first base element is configured such that a user exercises by deflecting one or more of the resilient members supported by the first base element; and the second base element is configured such that a user exercises by deflecting one or more of the resilient members supported by the second base element; and the second base element is positioned so as to be usable at the same time the first base element is being used.

Arrangement 18: The device of Arrangement 17, comprising:

the plurality of resilient members comprise a first resilient member configured to be supported by any one of the connection interfaces in a cantilever disposition; and a second resilient member configured to be supported by any one of the connection interfaces in a cantilever disposition;

wherein:

the first and second resilient members are configured to produce a resistance force when a user exerts a force thereon so as to bend at least a portion of the resilient member, effecting an exercising of one or more muscles in the user's body;

the first resilient member is stiffer than the second resilient member such that a greater force is required to bend at least a portion of the first resilient member as compared to the second resilient member; and each connection interface is configured to support either one of the first and second resilient members.

Arrangement 19: The device of any one of the previous arrangements of this arrangement sub-set, wherein the supplemental exercise element comprises at least one of a rotating platform, a spinning platform, a treadmill, set of pedals, crank, and resistance mechanism configured to provide resistance to the pedals and crank, a set of pedals configured to move in a circular or an elliptical pathway, a stationary bicycle, a spin bicycle, elliptical machine, a slide board, step climber, stair climber, recumbent exercise device, recumbent stepper, recumbent elliptical machine, and a recumbent bicycle.

Arrangement 20: The device of any one of the previous arrangements of this arrangement sub-set, comprising:

the plurality of resilient members comprise a first resilient member configured to be supported by any one of the connection interfaces in a cantilever disposition; and a second resilient member configured to be supported by any one of the connection interfaces in a cantilever disposition;

wherein:

the first and second resilient members are configured to produce a resistance force when a user exerts a force thereon so as to bend at least a portion of the resilient member, effecting an exercising of one or more muscles in the user's body;

the first resilient member has a cross-sectional size that is different than the cross-sectional size of the second resilient member; and each connection interface is configured to support either one of the first and second resilient members.

Arrangement 21: The device of any one of the previous arrangements of this arrangement sub-set, wherein the first base element and the second base element are supported by a frame structure that is supported by the support structure.

Arrangement 22: The device of any one of the previous arrangements of this arrangement sub-set, wherein the support structure is a ground or a wall surface.

Arrangement 23: The device of any one of the previous arrangements of this arrangement sub-set, wherein the first base element and the second base element each have a generally arcuate shape.

Arrangement 24: The device of Arrangement 23, wherein one or more of the connection interfaces are openings formed generally perpendicular to an arcuate surface of the first base element and the second base element.

Arrangement 25: The device of any one of the previous arrangements of this arrangement sub-set, wherein:

the first axial centerline and the second axial centerline define a first plane;

the third axial centerline and the fourth axial centerline define a second plane; and the first plane is not coplanar with the second plane.

Arrangement 26: The device of any one of the previous arrangements of this arrangement sub-set, wherein the device is configured such that the first set of connection interfaces can be used by a first user and the second set of connection interfaces can be simultaneously used by a second user.

Arrangement 27: A method of exercising one or more muscles of the body using an exercise device, comprising:

supporting at least a portion of at least one resilient member with a first connection interface;

grasping the at least one resilient member with one's hand or hands;

exerting a force on the at least one resilient member so as to deflect at least a portion of the resilient member from the longitudinal axis of the relaxed position of the resilient member and effect an exercising of one or more muscles in the user's body; and exercising a portion of the body with a supplemental exercise element configured to provide an additional mode of exercise separate and independent from the at least one resilient member, the supplemental exercise element being usable simultaneously with the resilient members.

Arrangement 28: The method of exercising of Arrangement 26, further comprising adjusting the angular orientation of the centerline of the at least one resilient member from the first angular orientation to the second angular orientation by disengaging the resilient member from the first connection interface and supporting the resilient member with a second connection interface, the second connection interface having a different position and/or angular orientation compared to the first connection interface.

Arrangement 29: A device for exercising the muscles in one's body, said device comprising:

a base member supportable by a support element, the support element defining a normal axis that is perpendicular to a surface of the support element that the base member is coupled with;

a plurality of openings formed in the base, each opening configured so as to define a first axis disposed generally axially through at least a portion thereof;

two resilient members, each comprising a first end portion and defining a second axis disposed generally axially through at least a portion of the first end portion thereof;

a supplemental exercise element configured to provide an additional mode of exercise separate and independent from the resilient members, the supplemental exercise element being usable simultaneously with the resilient members;

wherein:

the openings are each configured to provide a removable support for the first end portion of the resilient members, each resilient member being supported so that the second axis of the first end portion of the resilient member is generally aligned with the first axis of the opening providing the removable support and so that the resilient member extends from the opening in a cantilevered disposition;

each opening is configured so as to prevent the first end portion of the resilient member supported by the opening from rotating relative to the base about an axis that is generally perpendicular to the first axis of the opening;

each resilient member is configured to produce a resistance force when a user exerts a force thereon so as to deflect at least a portion of the resilient member from the longitudinal axis of the relaxed position of the resilient member, effecting an exercising of one or more muscles in the user's body;

at least one of the plurality of the openings is formed in the base member and is oriented at a first angular orientation such that the first axis thereof is non-parallel to the normal axis;

at least one of the plurality of the openings is formed in the base at a second angular orientation that is different than the first angular orientation; and the device is configured such that the angular orientation of the centerline of at least a portion of each resilient member is adjustable from the first angular orientation to at least the second angular orientation without deflecting the resilient member from the longitudinal axis of the relaxed position of the resilient member by varying the opening defining the removable support of the resilient member.

Arrangement 30: The device of Arrangement 29, wherein the supplemental exercise element comprises at least one of a rotating platform, a vibrating platform, a spinning platform, a treadmill, set of pedals, crank, and resistance mechanism configured to provide resistance to the pedals and crank, a set of pedals configured to move in a circular or an elliptical pathway, a stationary bicycle, a spin bicycle, elliptical machine, a slide board, step climber, stair climber, recumbent exercise device, recumbent stepper, recumbent elliptical machine, and a recumbent bicycle.

Arrangement 31: The device of any one of the previous arrangements of this arrangement sub-set, wherein the support element is also configured to support one or more components of the supplemental exercise element.

Arrangement 32: The device of any one of the previous arrangements of this arrangement sub-set, wherein at least a portion of the base defines a first side and a second side and wherein the connection interfaces are substantially symmetrically disposed on the first and second sides of the base.

Arrangement 33: The device of any one of the previous arrangements of this arrangement sub-set, wherein the first base portion comprises a generally flat, generally horizontally oriented surface to support the user of the device, the first base portion being adapted to be supported by a generally horizontal support surface.

Arrangement 34: The device of any one of the previous arrangements of this arrangement sub-set, wherein at least a portion of the base is fixed to a support structure.

Arrangement 35: The device of any one of the previous arrangements of this arrangement sub-set, wherein the device is configured such that at least one end of an axially resilient resistance member can be supported by the device.

Arrangement 36: The device of any one of the previous arrangements of this arrangement sub-set, wherein a plurality of openings are formed in the base member.

Arrangement 37: The device of any one of the previous arrangements of this arrangement sub-set, wherein at least one of the plurality of the openings is formed in the base at a third angular orientation that is non-parallel to the normal axis, the third angular orientation being different than the first angular orientation and the second angular orientation.

Arrangement 38: The device of any one of the previous arrangements of this arrangement sub-set, wherein at least one of the plurality of the openings is formed in the base at an angle that is from approximately 45 degrees to approximately 90 degrees relative to the normal axis.

Arrangement 39: The device of any one of the previous arrangements of this arrangement sub-set, wherein the first angular orientation and the second angular orientation are each measured relative to at least one of a longitudinal centerline axis of the first base portion in a plane that is parallel to the support surface and the normal axis in a plane that is perpendicular to the support surface.

Arrangement 40: A method of exercising the muscles of one's body, comprising:

supporting at least a portion of a pair of resilient members with the at least one support member defining a plurality of supports for the resilient members so that each resilient member extends from the at least one support member in a cantilevered disposition, wherein the plurality of supports are each configured to prevent at least a portion of the resilient member from pivoting relative to the base member when a force is applied to the resilient member;

grasping at least one resilient members in one's hands;

exerting a force on at least one resilient member so as to deflect at least a portion of the resilient member from the longitudinal axis of the relaxed position of the resilient member and effect an exercising of one or more muscles in the user's body; and exercising at least a portion of one's body with a supplemental exercise element configured to provide an additional mode of exercise in addition to the resilient members.

Arrangement 41: The method of Arrangement 40, wherein the supplemental exercise element comprises at least one of a rotating platform, a spinning platform, a treadmill, set of pedals, crank, and resistance mechanism configured to provide resistance to the pedals and crank, a set of pedals configured to move in a circular or an elliptical pathway, a stationary bicycle, a spin bicycle, elliptical machine, a slide board, step climber, stair climber, recumbent exercise device, recumbent stepper, recumbent elliptical machine, and a recumbent bicycle.

Arrangement 42: The method of any one of the arrangements of this arrangement sub-set, further comprising adjusting the angular orientation of the centerline of at least a portion of at least one of the resilient members from a first angular orientation of at least a second angular orientation by either removing the resilient member from the support defining the first angular orientation and placing it in another support having the second angular orientation or adjusting the angle of the base member such that at least a portion of the at least one of the resilient members can be oriented in a plurality of angular orientations without deflecting the resilient members can be oriented longitudinal axis of the relaxed position of the resilient member;

wherein:

the orientation of the first angular orientation is different than the orientation of the second angular orientation; and at least one of the first angular orientation and the second angular orientation is non-parallel to a normal axis that is perpendicular to the support surface.

Arrangement 43: The method of any one of the arrangements of this arrangement sub-set, further comprising varying the location of the one of the plurality of supports with respect to the base such that at least a portion of the resilient member can be positioned in any of a plurality of locations on the base.

Arrangement 44: The method of any one of the arrangements of this arrangement sub-set, comprising adjusting the angular orientation of the centerline of at least a portion of at least one of the resilient members from either the first angular orientation or the second angular orientation to a third angular orientation, wherein the orientation of the third angular orientation is different than the orientation of the first angular orientation and the second angular orientation.

Arrangement 45: The device of any one of the arrangements of this arrangement sub-set, wherein the first angular orientation and the second angular orientation are each measured relative to a longitudinal centerline axis of the first base portion in a plane that is parallel to the support surface.

Arrangement 46: The device of any one of the arrangements of this arrangement sub-set, wherein at least a portion of the base is supportable by a vertically oriented support structure.

Arrangement 47: A device for exercising the muscles in a user's body, the device comprising:

a base comprising at least one base portion, a first base member, and a second base member;

a plurality of connection interfaces supported by each of the first base member and the second base member;

two resilient members, each comprising a first portion and a second portion;

a second exercise element configured to provide an additional mode of exercise in addition to the resilient members;

wherein:

the first base member is supported by the at least one base portion at a first location and a first angular orientation;

the second base member is supported by the at least one base portion at a second location that is different than the first location and a second angular orientation that is different than the first angular orientation;

the second portion of each resilient member is configured so as to define a longitudinal axis disposed generally longitudinally through at least a portion of the second portion;

the plurality of connection interfaces supported by each of the first base member and the second base member are each configured to support at least the first portion of the resilient member such that the resilient member is extendable from the base in a cantilevered disposition such that at least the first portion of the resilient member is prevented from pivoting relative to the base, at least a portion of the second portion of the resilient member being unrestrained in a direction that is perpendicular to the longitudinal axis of the second portion of the resilient member;

each resilient member is configured to produce a resistance force when a user exerts a force on the resilient member so as to deflect at least a portion of the resilient member from the longitudinal axis of the relaxed position of the resilient member.

Arrangement 48: The device of Arrangement 47, wherein the second exercise element comprises at least one of a rotating platform, a spinning platform, a treadmill, set of pedals, crank, and resistance mechanism configured to provide resistance to the pedals and crank, a set of pedals configured to move in a circular or an elliptical pathway, a stationary bicycle, a spin bicycle, elliptical machine, a slide board, step climber, stair climber, recumbent exercise device, recumbent stepper, recumbent elliptical machine, and a recumbent bicycle.

Arrangement 49: The device of any one of the arrangements of this arrangement sub-set, wherein the second exercise element is usable simultaneously with the resilient members.

Arrangement 50: The device of any one of the previous arrangements of this arrangement sub-set, wherein the base is configured to support the second exercise element.

Arrangement 51: The device of any one of the previous arrangements of this arrangement sub-set, wherein the base is configured to support the second exercise element and is coupled with the second exercise element.

Arrangement 52: The device of any one of the previous arrangements of this arrangement sub-set, wherein at least one of the connection interfaces is defined by an opening formed in at least one of the first and second base members.

Arrangement 53: The device of any one of the previous arrangements of this arrangement sub-set, wherein at least a portion of one or more of the openings is generally cylindrically shaped.

Arrangement 54: The device of any one of the previous arrangements of this arrangement sub-set, wherein at least a portion of one or more of the openings is generally conically shaped.

Arrangement 55: The device of any one of the previous arrangements of this arrangement sub-set, wherein at least one of the first and second base members is rotatable such that the angular orientation of at least one connection interface can be varied by varying the angular orientation of at least one of the first and second base members.

Arrangement 56: The device of any one of the previous arrangements of this arrangement sub-set, wherein at least one of the first and second base members is moveable such that the location of at least one connection interface can be varied by varying the location of at least one of the first and second base members.

Arrangement 57: The device of any one of the previous arrangements of this arrangement sub-set, wherein at least a portion of the base is fixed to a support structure.

Arrangement 58: The device of Arrangement 57, wherein the at least a portion of the base is supportable by a vertically oriented support structure.

Arrangement 59: The device of any one of the previous arrangements of this arrangement sub-set, comprising a balance device adapted to be carried by the base.

Arrangement 60: The device of any one of the previous arrangements of this arrangement sub-set, wherein at least one of the resilient members comprises a solid cross-section.

Arrangement 61: The device of any one of the previous arrangements of this arrangement sub-set, wherein at least one of the resilient members comprises at least one opening extending generally longitudinally through at least a portion of the resilient member.

Arrangement 62: The device of Arrangement 61, further comprising at least one stiffener member disposed in the at least one opening in the resilient member.

Arrangement 63: The device of any one of the previous arrangements of this arrangement sub-set, wherein at least one resilient member is configured to support a "W" shaped handle, and individual handle, a rope, or other suitable handle.

Arrangement 64: The device of any one of the previous arrangements of this arrangement sub-set, wherein at least a portion of at least one resilient member is curved or angled.

Arrangement 65: The device of any one of the previous arrangements of this arrangement sub-set, wherein at least one of the resilient members comprises: a first member that is substantially rigid; and a second member that is resilient about at least a substantial portion of its length, the second member comprising a first portion and a second portion, wherein; the first member is positioned generally at the first end portion of the resilient member; the first member is configured to support at least the first portion of the second member such that the second member extends from the first member in a cantilevered disposition so that the first portion of the second member is prevented from pivoting relative to the first member; and the second member is configured to produce a resistance force when a user exerts a force on the second member so as to deflect at least a portion of the second member from the longitudinal axis of the relaxed position of the second member.

Arrangement 66: The device of any one of the previous arrangements of this arrangement sub-set, wherein the resilient member is configured to support at least a third member, the third member being resilient about at least a substantial portion of its length and being configured to increase the resistance force produced by the resilient member when a portion of the resilient member is deflected from the longitudinal axis of the relaxed position of the resilient member.

Arrangement 67: The device of any one of the previous arrangements of this arrangement sub-set, wherein the third member is supported by the first member in a cantilevered disposition such that at least a portion of the third member is prevented from pivoting relative to the first member when a force is applied to the resilient member so as to deflect at least a portion of the resilient member from the longitudinal axis of the relaxed position of the resilient member.

Arrangement 68: The device of any one of the previous arrangements of this arrangement sub-set, further comprising a third base member supported by the at least one base portion at a third location and a third angular orientation, the third location being different than the first location and the second location, and the third angular orientation being different than at least one of the first angular orientation and the second angular orientation, wherein the third base member supports one or more connection interfaces.

Arrangement 69: The device of any one of the previous arrangements of this arrangement sub-set, wherein at least one resilient member is configured to support a stiffener member configured to increase the resistance force produced by the resilient member when a user exerts a force on the resilient member so as to deflect at least a portion of the resilient member from the longitudinal axis of the relaxed position of the resilient member.

Arrangement 70: The device of any one of the previous arrangements of this arrangement sub-set, wherein the device is configured such that: the first angular orientation and the second angular orientation are both non-parallel to the normal axis; the first axis of at least one of the openings in the first angular orientation is coplanar with a first plane that is perpendicular to the support surface; the first axis of at least one of the openings in the second angular orientation is coplanar with a second plane that is perpendicular to the support surface, and the first plane is not parallel to or coplanar with the second plane.

Arrangement 71: The device of any one of the previous arrangements of this arrangement sub-set, wherein at least one of the plurality of the openings is formed in the base at a third angular orientation wherein the first axis thereof is non-parallel to the normal axis, the third angular orientation being different than the first angular orientation and the second angular orientation.

Arrangement 72: The device of any one of the previous arrangements of this arrangement sub-set, wherein the device is configured such that: the first axis of at least one of the openings in the third angular orientation is coplanar with a third plane that is perpendicular to the support surface; and the third plane is not parallel to or coplanar with the first plane or the second plane.

Arrangement 73: The device of any one of the previous arrangements of this arrangement sub-set, wherein at least one of the plurality of the openings is formed in the base at a fourth angular orientation that is non-parallel to the normal axis, the fourth angular orientation being different than the first angular orientation, the second angular orientation, and the third angular orientation.

Arrangement 74: The device of any one of the previous arrangements of this arrangement sub-set, wherein at least one of the first base member and the second base member is supported by the at least one base portion so as to be entirely above of the at least one base portion.

Arrangement 75: The device of any one of the previous arrangements of this arrangement sub-set, wherein the device is configured such that the resistance generated by the resilient members can be varied without changing the size or shape of the connection interfaces.

Arrangement 76: The device of any one of the previous arrangements of this arrangement sub-set, wherein the base comprises a generally flat, generally horizontally oriented surface to support the user of the device.

Arrangement 77: The device of any one of the previous arrangements of this arrangement sub-set, wherein at least one resilient member is configured such that a handle member can be supported thereby, the handle member being configured to at least allow the user to vary the orientation of his or her hand relative to the resilient member.

Arrangement 78: The device of any one of the previous arrangements of this arrangement sub-set, wherein the plurality of connection interfaces comprises one or more projections projecting from the base, the projections each being configured to provide a removable support for at least the first end portion of at least one of the resilient members.

Arrangement 79: The device of any one of the previous arrangements of this arrangement sub-set, wherein the device is configured such that at least one end of an axially resilient resistance member can be supported by the device.

Arrangement 80: The device of any one of the previous arrangements of this arrangement sub-set, wherein at least one of the plurality of connection interfaces is formed in the base at an angle that is from approximately 15 degrees to approximately 30 degrees relative to the normal axis.

Arrangement 81: The device of any one of the previous arrangements of this arrangement sub-set, wherein at least one of the plurality of connection interfaces is formed in the base at an angle that is from approximately 45 degrees to approximately 90 degrees relative to the normal axis.

In any arrangement disclosed herein, the exercise device can have two, three, four, five, or six or more resilient member support elements. Any of the resilient member support elements disclosed in any of the exercise system embodiments herein can be configured to have any of the details of any of other exercise system embodiments disclosed herein. For example and without limitation, the resilient member support element can be configured to support a resilient member in approximately 3 different angular orientations, or from approximately three different angular orientations and approximately 18 different angular orientations. Any of the resilient member support elements can be used with any of the device or platform embodiments disclosed herein in addition to or in the place of any of the resilient member support elements shown or described.

BRIEF DESCRIPTION OF THE DRAWINGS

These and other features, aspects and advantages of this disclosure will now be described in connection with some embodiments of the present disclosure, in reference to the accompanying drawings. The illustrated embodiments, however, are merely examples and are not intended to limit the present disclosure. The following are brief descriptions of the drawings.

DETAILED DESCRIPTION OF SOME EMBODIMENTS

Figure 1:
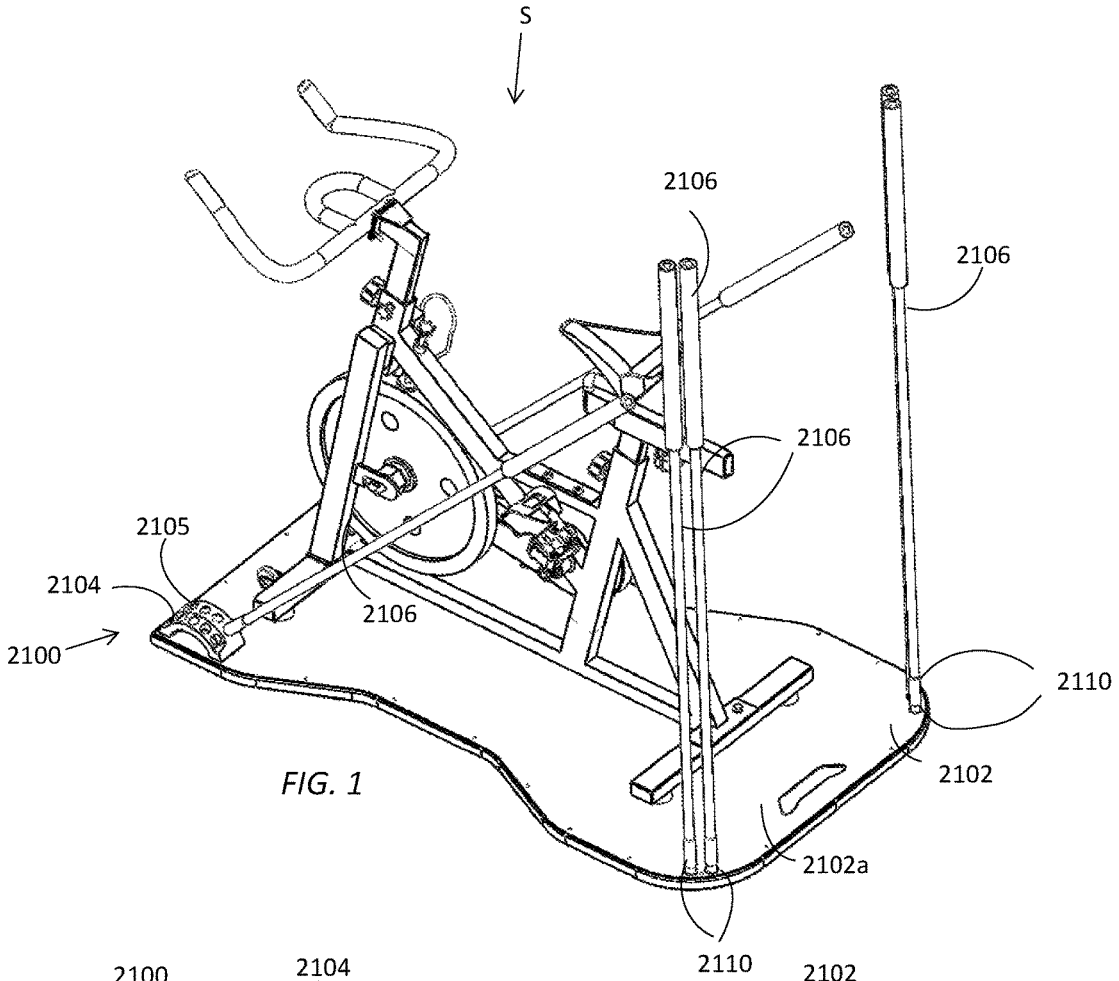
FIG. 1 is a perspective view of an embodiment of a resistance based exercise system that can be used with a cardio device, such as the exercise bike shown.

An exercise apparatus of the present disclosure comprising one or more resilient members for exercising is described herein. In the following description, numerous specific details are set forth by way of exemplary embodiments in order to provide a more thorough description of the present disclosure. It will be apparent, however, to one skilled in the art that the present invention may be practiced without these specific details. Unless specifically noted, it is intended that the words and phrases in the specification and claims be given the ordinary and accustomed meaning as understood by those of ordinary skill in the applicable art or arts. If any other meaning is intended, that special meaning will be disclosed herein. Furthermore, the scope of the present disclosure is not limited by the specific details of the embodiments described below. As an example, the number, location, and orientation of the connection interfaces or openings of each of the embodiment of the exercise apparatus of the present disclosure are not limited to the number, location, and orientation of the connection interfaces or openings specifically disclosed herein.

Any of the embodiments or the features, components, details, or otherwise thereof disclosed or incorporated by reference herein, including without limitation the resilient member embodiments, resilient member support embodiments, base components or supports, or otherwise, can be used in combination with an additional exercise device or components thereof or additional exercise method including, without limitation, recumbent exercise bicycles, upright exercise bicycles, recumbent or upright steppers or stepping devices, indoor cycling bikes, recumbent elliptical machines, upright elliptical machines, treadmills, vibration platforms, or other cardiovascular or strength based exercise devices. For example, without limitation, any of the embodiments of the resilient members and/or resilient member supports (i.e., the components that support an end portion of one or more resilient members) disclosed or incorporated by reference herein can also be used with one or more of a rotating platform, a vibration platform or device, a spinning platform, a treadmill, set of pedals, crank, and resistance mechanism configured to provide resistance to the pedals and crank, a set of pedals or foot supports configured to move in a circular, elliptical, or lateral pathway, an upright or recumbent exercise bike, indoor cycling bike, a recumbent or upright elliptical fitness device, a slide board, step climber, stair climber, abdominal exercise device, recumbent exercise device, recumbent stepper or stepping device, upright stepper or stepping device, walking machines, treadmills or any other recumbent, supine, or upright fitness or exercise device (collectively referred to as a secondary exercise device or element) that a user can use while simultaneously strengthening one's muscles using one or more of the resilient members supported by a resilient member support or a pair of resilient member supports. The secondary exercise device can include any suitable cardiovascular or aerobic exercise device or other desired strength training device, including recumbent, upright, or cycling bikes, elliptical machines, or otherwise manufactured by SCIFIT™, LIFE FITNESS™, PRECOR™, or other exercise device manufacturers. The secondary exercise device can also be referred as a supplemental exercise device herein.

One benefit of using the resilient member support elements and resilient members with the secondary exercise element is that the resilient members are independently and freely bendable in any direction away from the resting position of the resilient members. This results in the user being able to freely move the resilient members independent of the motion involved in the secondary exercise device. For example, a user can move the resilient members independent of a pedaling motion (if on any of a variety of bicycling devices), or running motion (if on a treadmill), or elliptical or arcuate movement of the lower body, or stepping movement of the lower body, or even lateral movement of the lower body. Other devices on the market that allow a user to move his or her upper body while moving the lower body typically require the movement to be performed simultaneously and dependently. Here, with the arrangements disclosed herein, a user can perform movements with the resilient members in any direction, with one arm being moved independently and differently relative to the other arm, and out of sync with the lower body movement or movement of the secondary exercise device. Additionally, the resilient members allow resistance force in a multiplanar fashion, thereby resulting in a much more functional workout than with traditional exercise devices.

As mentioned, in any embodiments disclosed herein, the exercise system can have any of the components, features, configurations, or any of the details of any of the embodiments of the resistance member platforms or systems disclosed herein.

FIG. 1 is a perspective view of an embodiment of a resistance based exercise system 2100 that can be used with a secondary exercise device, such as the upright exercise bike shown. The resistance based exercise system 2100 can have a platform or base 2102 (also referred to herein as a base member) that can be sized and configured to support a secondary exercise device S and permit the simultaneous or independent use of the resistance members of the resistance based exercise system and/or the secondary exercise device. In the illustrated embodiment, the exercise device is an upright or indoor cycling bicycle. The resistance based exercise system can be configured such that the secondary exercise device can be positioned and supported on a top surface 2102*a* of the platform 2102 such that a user can use the resistance members of the resistance based exercise system independent of or in conjunction with the use of the secondary exercise device. In any of the embodiments disclosed herein, a user can then perform the aerobic or cardiovascular exercise on the cardiovascular exercise device while simultaneously and/or intermittently strengthening his or her muscles by deflecting the resilient members 2106. This combination of different exercise modalities can have tremendous strengthening benefits and cardiovascular benefits for the user, while also making the exercise program more dynamic and engaging for the user.

Figure 2:
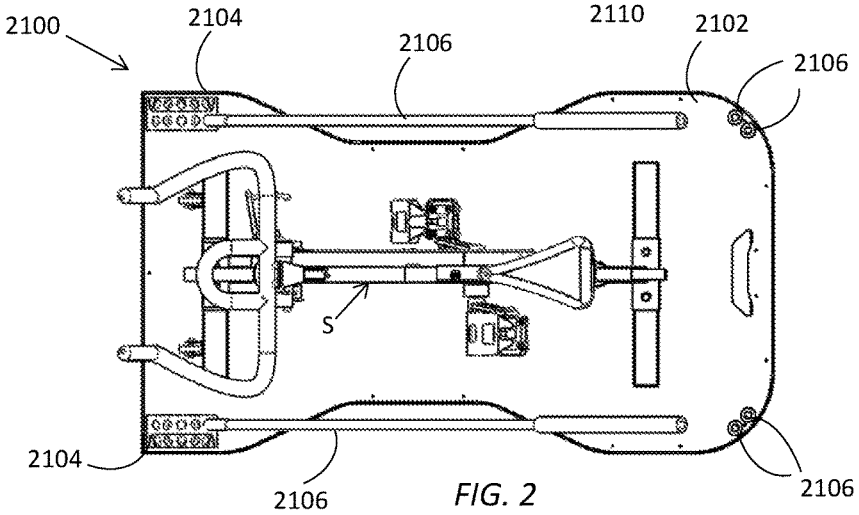
FIG. 2 is a top view of the embodiment of the resistance based exercise system shown in FIG. 1.
Figure 3:
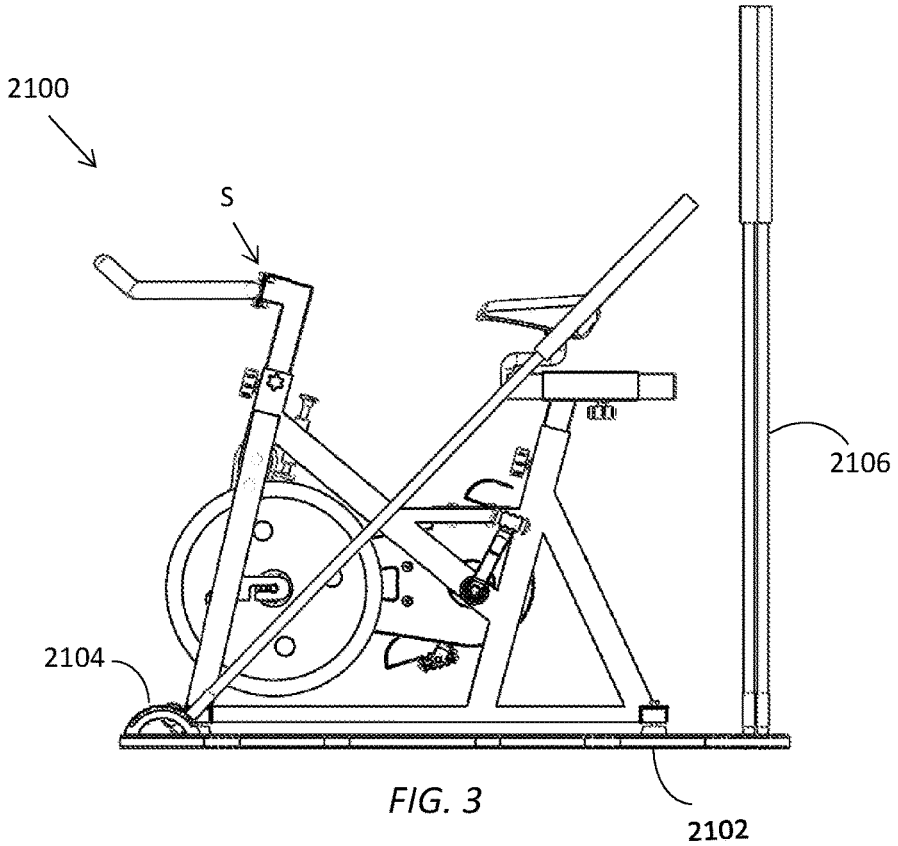
FIG. 3 is a side view of the embodiment of the resistance based exercise system shown in FIG. 1.

With reference to FIGS. 1-3, the exercise system 2100 can have a platform 2102 that can be configured to support one or more resilient member support elements 2104. The resilient member support elements 2104 can have any of the features, shapes, components, materials, or other details of any of the embodiments of the resilient member supports in this disclosure or incorporated by reference herein, such as those disclosed in U.S. Pat. No. 8,500,612 and U.S. Pat. No. 7,704,199, which are hereby incorporated by reference as if fully set forth herein. Similarly, any of the embodiments of the resilient members disclosed herein can have any of the features, shapes, components, materials, or other details of any of the embodiments of the resilient members disclosed elsewhere in this disclosure or incorporated by reference herein, such as those disclosed in U.S. Pat. No. 8,500,612 and U.S. Pat. No. 7,704,199, which are hereby incorporated by reference as if fully set forth herein. Further, any of the resilient member support elements and/or resilient members disclosed below or any components, features, shapes, or other details thereof can be used in addition to or in place of any the other resilient member support elements and/or resilient members described with respect to any of the other exercise system embodiments disclosed herein.

In the illustrated embodiment, the platform 2102 can support one or more resilient member support elements 2104, two being shown. In any resilient member fitness system embodiments disclosed herein, including resilient member fitness system 2100, the platform can support three or more resilient member support elements. In any embodiments disclosed herein, an additional resilient member support element can be positioned on the platform off of the front and of the cardio device so that a user standing on the ground can exercise using the resilient members by standing on the ground surface in front of the bike. In this arrangement, the platform, such as platform 2102, can be extended further to accommodate and structurally support the additional resilient member support element.

Any embodiments of the resilient member support elements can have an arcuate shape and one or a plurality of openings 2105 therein. Any embodiments of the resilient member support elements can also have a generally planar surface through which the openings can pass. The openings can also be referred to herein as connection interfaces. Each of the openings can be configured to support a resilient member 2106 therein. For example and without limitation, in the illustrated embodiment or in any embodiments herein, the resilient member support elements can have 10 or more openings, each of the openings being position and angled different from one another. For example, in the illustrated embodiment, the resilient member support element can have two rows of openings formed therein, each of the two rows of openings having five openings. In any embodiments disclosed herein, the openings in each of the rows can be separated by an angle between approximately 15° or less and approximately 25° or more, or an angle that is approximately 22°. In the illustrated embodiment, the innermost row of openings can have an angle of approximately 44°, approximately 22°, approximately 0°, approximately −22°, and approximately −44°, respectively, relative to the vertical orientation. The negative sign is to indicate that the opening is angled away from the user. In any embodiments, the resilient member support elements can support the resilient members at greater angles relative to the vertical orientation, such as approximately 66°, or approximately 90° relative to vertical, or any desired angle between approximately 0° and approximately 90°.

Any embodiments of the resilient member support elements disclosed herein can also have an outer or outermost row of openings. The outermost row of openings (i.e. the row of openings that is closest to the side or outside edge of the platform) can be angled away from the midline of the platform at any desired angle. For example and without limitation, the outermost row of openings can be angled away from a vertical plane by approximately 15°, or approximately 17°, or from approximately 12° to approximately 20° or more. In the illustrated embodiment, the outermost row of openings can have an angle of approximately 44°, approximately 22°, approximately 0°, approximately −22°, and approximately −44°, respectively, relative to the vertical orientation, while also being tilted away from the vertical plane by approximately 15°, or approximately 17°, or from approximately 12° to approximately 20° or more. The negative sign is to indicate that the opening is angled away from the user. Any embodiments of the resilient member support elements can also have a third row of openings. The third openings can have an angle of approximately 44°, approximately 22°, approximately 0°, approximately −22°, and approximately −44°, respectively, relative to the vertical orientation, while also being tilted inwardly by approximately 15°, or approximately 17°, or from approximately 12° to approximately 20° or more. In any embodiments disclosed herein, the resilient members can be supported by the resilient member support elements in any range of angular orientations and/or locations. In any embodiments of the resilient member support elements disclosed herein, the outer row of openings or connections interfaces can be removed to simplify the resilient member support element.

In any of the embodiments disclosed herein, the resilient member support elements can be supported by a base member that is independently moveable with respect to the secondary exercise device or components, or which is coupled with or part of the secondary exercise device or components. Alternatively, the resilient member support elements can be supported by the secondary exercise device or a portion thereof so as to be integral with the secondary exercise device and not require the need for a base member or platform.

For example, in any embodiments disclosed herein, the base member can be configured to be positioned under the secondary exercise device or portion thereof and can be configured such that the weight of the secondary exercise device or portion thereof that is positioned on top of the base member can be used to stabilize the base member when the resilient members are being used. In this configuration, the base member and resilient members can be used with any existing secondary exercise device without modification of the secondary device or components thereof. In any embodiments disclosed herein, the resilient member supports can be positioned on the base member such that, when the secondary exercise device is resting (removably) on top of the base member, the resilient member supports can be positioned laterally outside of the structure of the secondary exercise device so that the movement (or, at least, a substantial range of movement) of the resilient members will not be significantly obstructed by the secondary exercise device.

Figure 6:
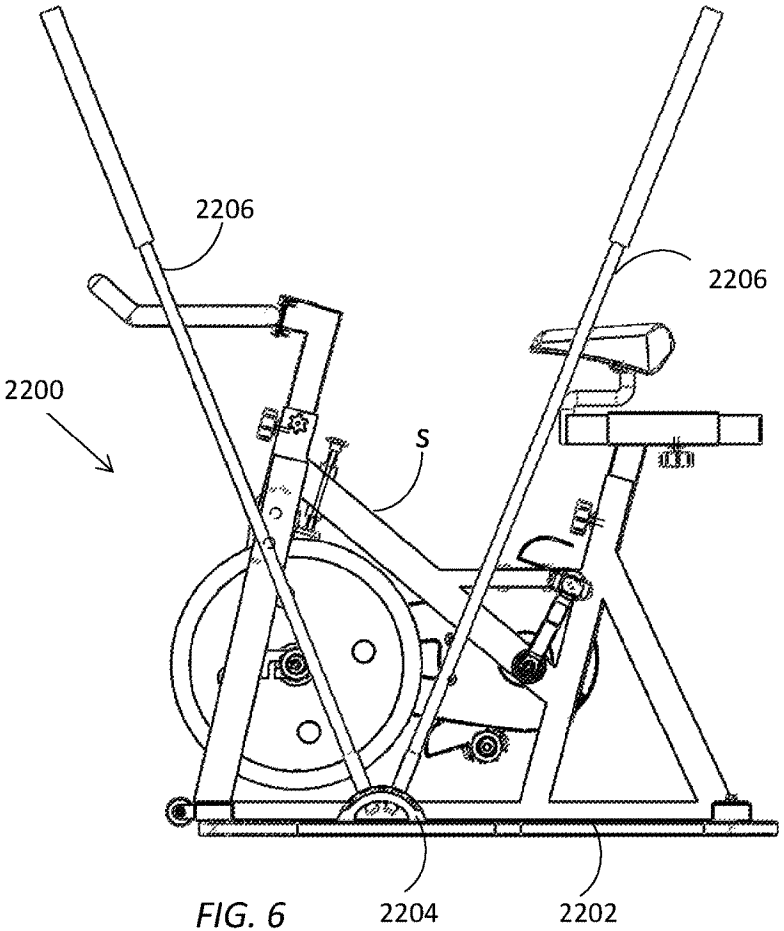
FIG. 6 is a side view of the embodiment of the resistance based exercise system shown in FIG. 5.
Figure 5:
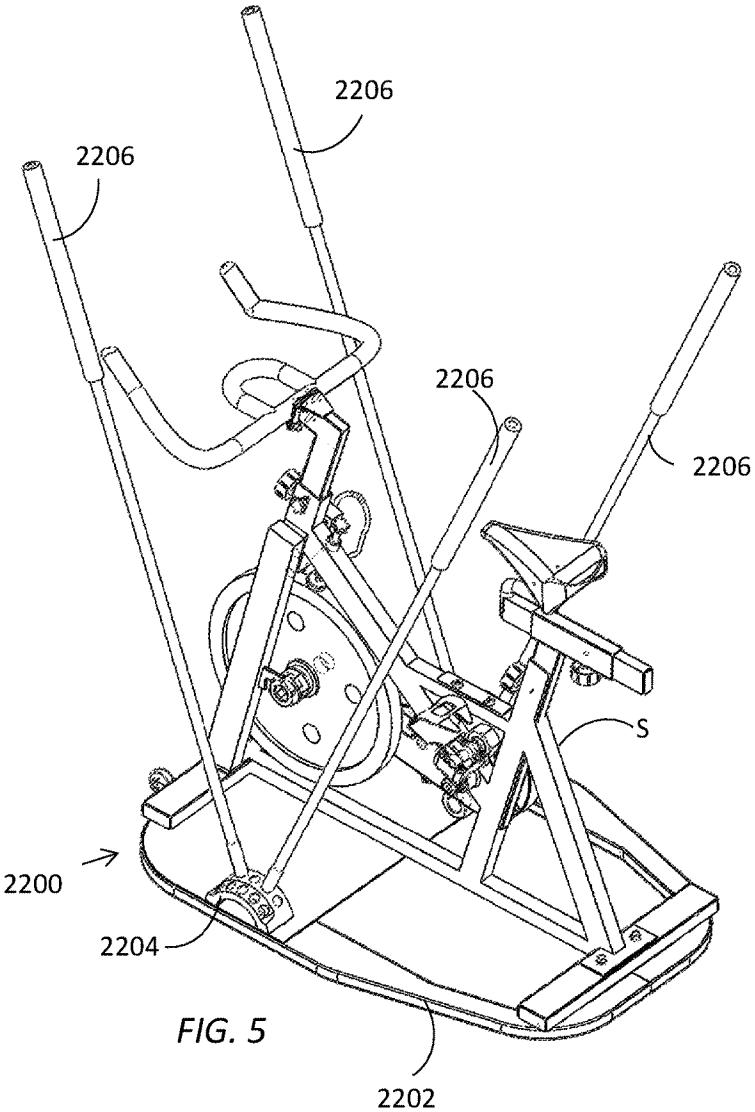
FIG. 5 is a perspective view of another embodiment of a resistance based exercise system that can be used with or coupled with a cardio device, such as the exercise bike shown.
Figure 7:
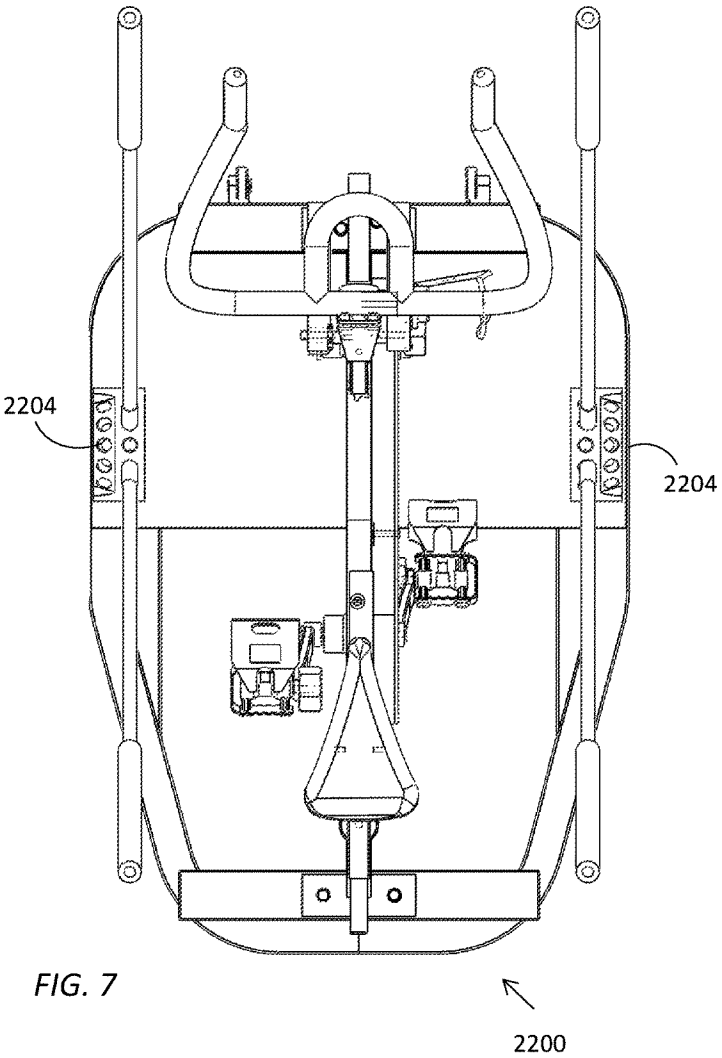
FIG. 7 is a top view of the embodiment of the resistance based exercise system shown in FIG. 5.

Alternatively, in any embodiments disclosed herein, the resilient member supports can be attached to a portion of the secondary exercise device, or to a frame or support element of the secondary exercise device so as to have a more integrated design. With reference to FIGS. 5-7, the resilient member supports can be coupled with a frame structure or other support structure of the secondary exercise device (which, again, can be a treadmill, exercise bicycle, elliptical machine, stepper device, or any other cardiovascular or suitable strength training exercise device). Again, as with any embodiments disclosed in this patent description, the resilient member supports and resilient members can have any of the same features of any of the other resilient member supports and resilient members disclose in any other portion or with respect to any other assembly disclosed in this application.

Any of the exercise device embodiments disclosed herein can be configured to support one or more resilient members when not being used. For example, with reference to FIGS. 1 and 3, the base member or the frame of the secondary exercise device can have one or more supports 2110 for supporting one or more resilient members when not being used, so that a user can easily access a different set of resilient members when they desire an additional one or more resilient member or different level of resistance in the resilient member. In the embodiment illustrated in FIGS. 1-3, the base member can be configured to support four resilient members when not being used. Any embodiments of the resistance based exercise system disclosed herein can be configured to have supports for the resilient members integrated or coupled with the base member or integrated or coupled with the secondary exercise device, including without limitation the frame or support structure of the secondary exercise device.

Figure 4:
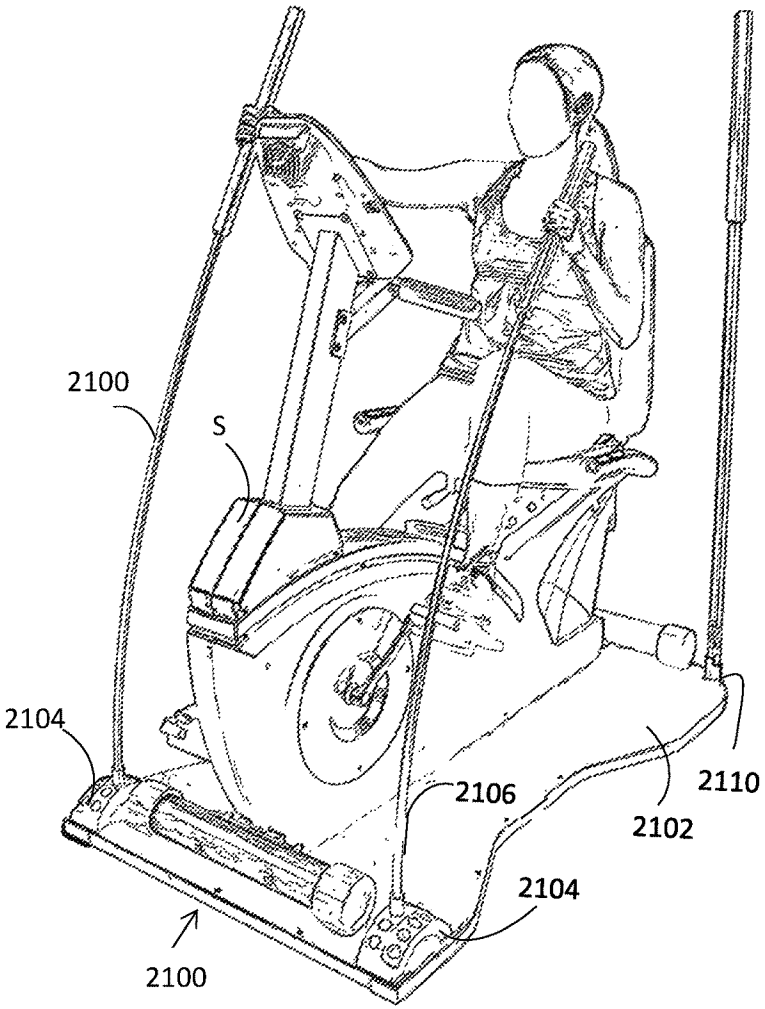
FIG. 4 is a perspective view of another embodiment of a resistance based exercise system that can be used with a cardio device, such as the exercise bike shown.

FIG. 4 illustrates another type of secondary exercise device which can be used with the exercise system 2100. The secondary exercise device shown in FIG. 4 is a recumbent bicycle. FIG. 4 shows the secondary exercise device being used simultaneously with the resilient members of the exercise system 2100. The resilient members 2106 are being moved or bent in an alternating fashion at the same time that the recumbent bicycle is being pedaled. The additional benefit of this system is that the resilient member support elements 2104 can be said used to support resilient members for exercise even when the user is not on the secondary exercise device. For example and without limitation, the resilient member support elements 2104 can be positioned such that a user can stand to the side or on either side of the platform 2102 or even off the front end of the platform 2102 and engage resilient members 2106 supported by the resilient member support elements 2104. In this arrangement, four or more either in sequence or simultaneously using two or more, or three or more resilient member support elements 2104.

FIGS. 5-7 illustrate another embodiment of an exercise device 2200 which can have a platform or base member 2202 that can have any of the same features, components, materials, or other details of any of the other embodiments disclosed herein. With reference to FIG. 5, the resistance based exercise system 2200 can have a platform 2202 and support structure and two or more resilient member support elements 2204. The resistance based exercise system 2200 can be used to support two or more resilient members 2206, or four or more resilient members 2206, as shown, simultaneously. The base member 2202 can be configured to bolt onto or otherwise couple with the secondary exercise device S so that the secondary exercise device is removably coupled with or fixed to the base member 2202. In this arrangement, the base member can be more securely positioned relative to the secondary exercise device during use and can permit a user to move the secondary exercise device and base member together and simultaneously. Additionally, the base member can be more compact and space saving in this configuration.

In some embodiments, the base member can be configured so that the base member can be easily attached to the secondary exercise device using standard fasteners. For example, the base member can be coupled with the secondary exercise device using bolts, screws, or other common fasteners. The base member can be configured such that the base member can be attached to the secondary exercise device without modification, or, in some embodiments, without substantial modification, of the secondary exercise device. For example, the threaded bosses used for rubber feet on the secondary exercise device can be used to receive bolts to attach or secure the base member to the secondary exercise device. Additionally, the frame or support structure of the secondary exercise device can be designed to support the resilient member support elements to provide the most refined and simplified design.

In some embodiments, as shown in FIG. 5, the resilient member support elements can be supported by the secondary exercise device or other structural frame member so as to be positioned near ground-level. Additionally, the resilient member support elements can be positioned in the lateral direction, i.e., in a direction away from the side portion of the secondary exercise device, that is outside of the envelope of space occupied by the user when the user is using the secondary exercise device. For example, with reference to FIG. 5, the resilient member support elements 2204 can be positioned laterally such that, when the user bends the resilient members 2206, the resilient members do not obstruct the path of movement of the user's feet or legs when peddling the secondary exercise device, and also such that the movement of the resilient minc embers is not obstructed by or interfered with by components of the secondary exercise device such as the handle bars, pedals, rotating belt of the treadmill, foot beds for elliptical or stepper machines, etc.

For example and without limitation, in any embodiments disclosed herein, the resilient member support elements can be laterally spaced such that the two resilient member support elements to the sides of the secondary exercise device are spaced apart by approximately 24 inches, or between approximately 23 inches and approximately 26 inches, or between 23 inches and approximately 25 inches. Additionally, the resilient member support elements can be laterally spaced such that the openings of the resilient member support elements in each of the two laterally spaced resilient member support elements to spaced apart by approximately 25.5 inches, from center to center, or from approximately 23 inches to approximately 28 inches, or from approximately 25 inches to approximately 26 inches.

Figure 8:
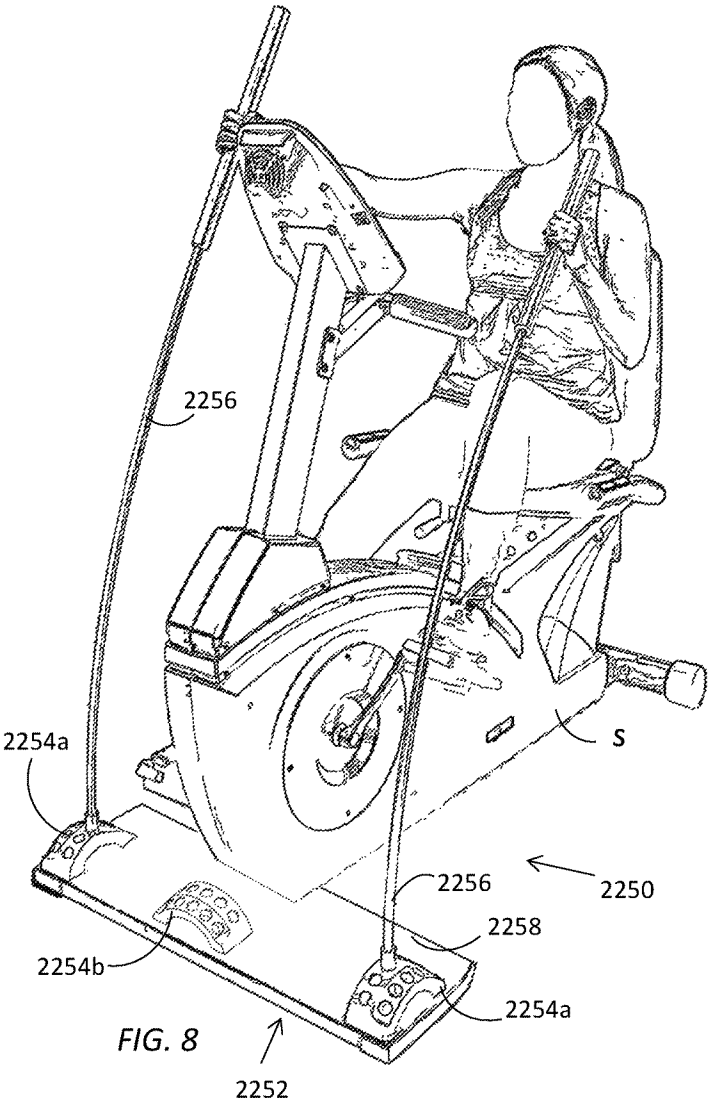
FIG. 8 is a perspective view of another embodiment of a resistance based exercise system, having resilient member support elements and the supporting frame therefor integrated with the frame or support structure of the secondary exercise device.
Figure 9:
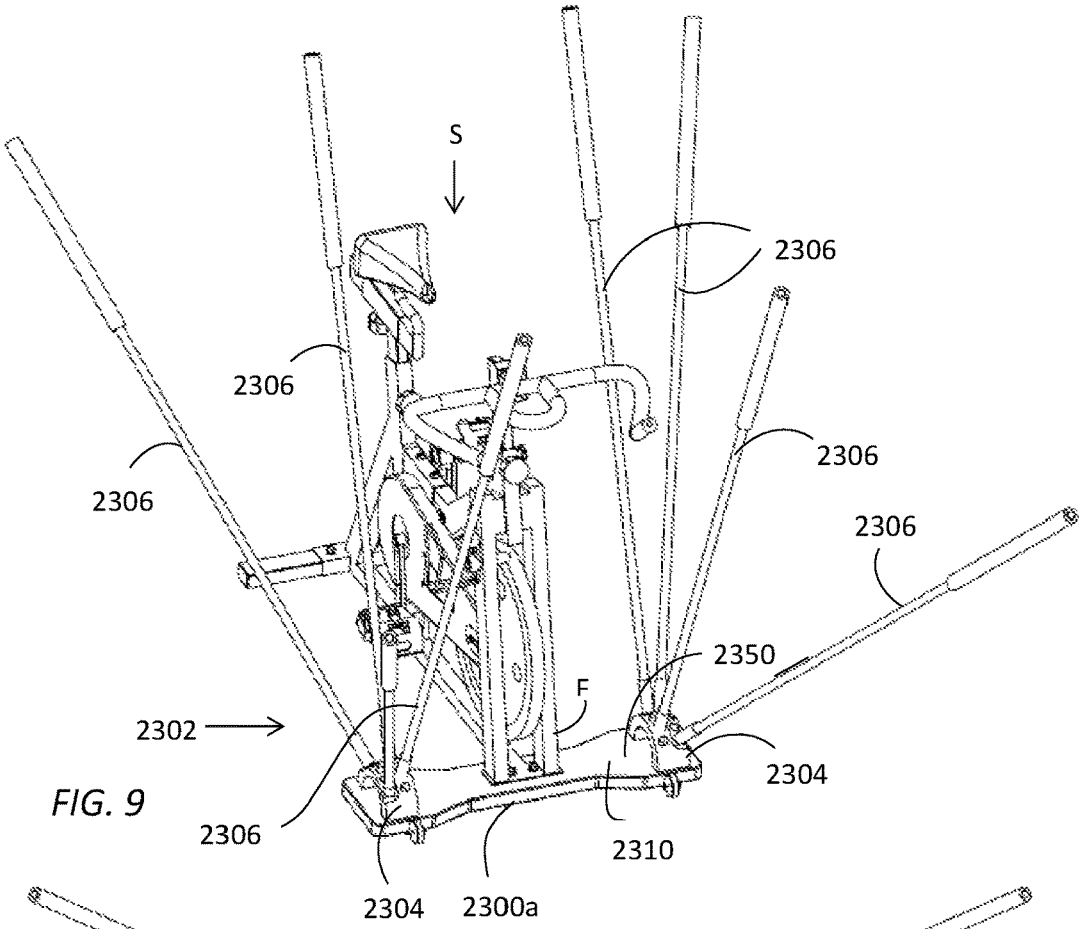
FIG. 9 is a perspective view of another embodiment of a resistance based exercise system, having resilient member support elements and the supporting frame therefor integrated with the frame or support structure of the secondary exercise device.
Figure 10:
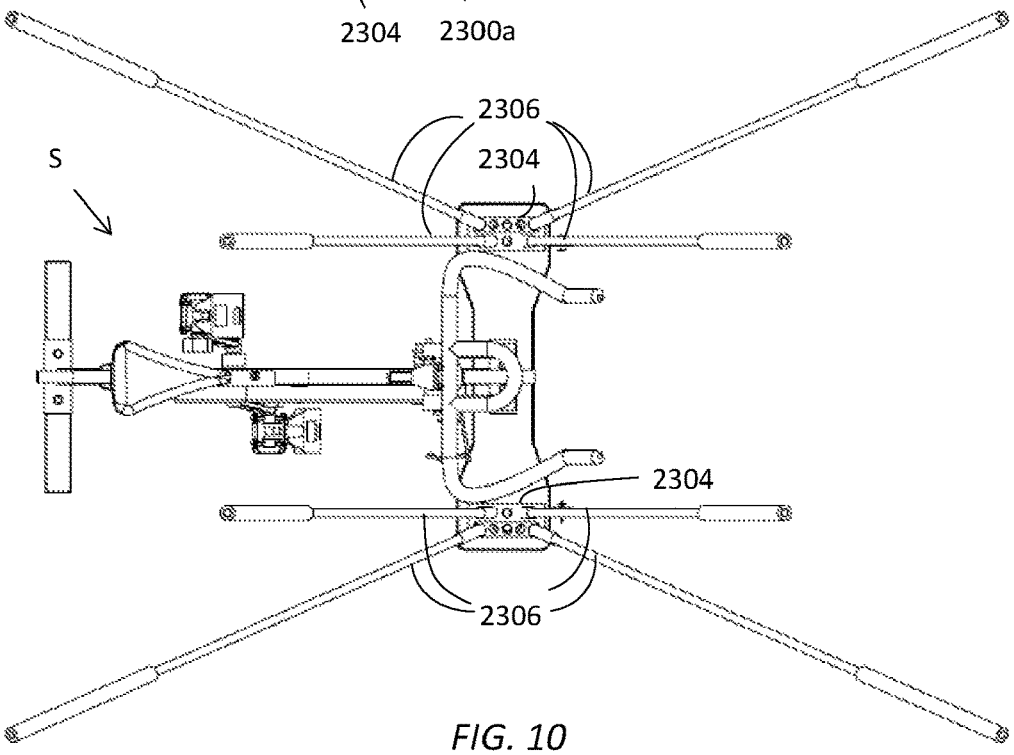
FIG. 10 is a top view of the embodiment of the resistance based exercise system shown in FIG. 9.
Figure 11:
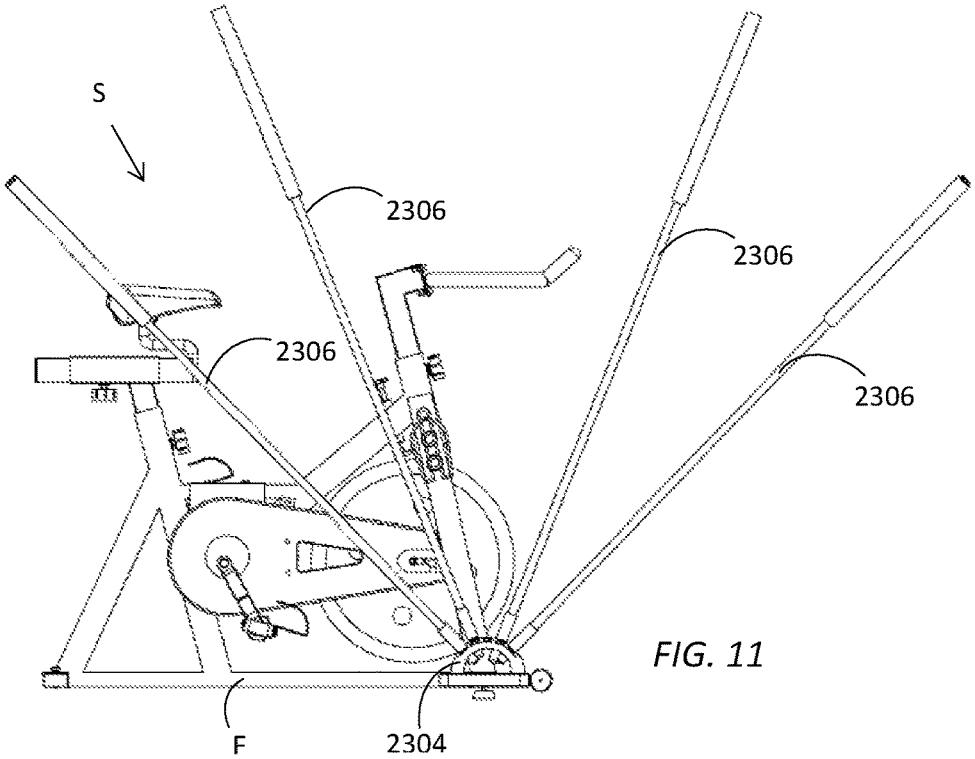
FIG. 11 is a side view of the embodiment of the resistance based exercise system shown in FIG. 9.
Figure 12:
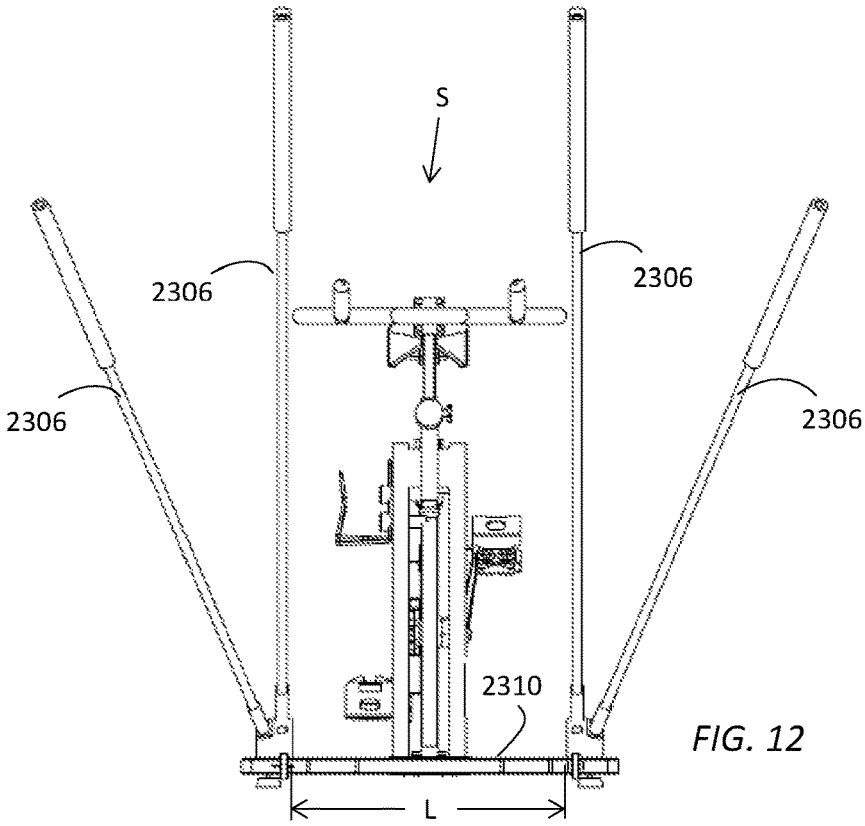
FIG. 12 is a front view of the embodiment of the resistance based exercise system shown in FIG. 9.

FIG. 8 shows another embodiment of an exercise system 2250. In the illustrated embodiment, a frame or support structure 2252 of the secondary exercise device S can be used to support one or more resilient member support elements 2254 or the support members supporting the resilient member support elements. The secondary exercise device S can be any suitable secondary exercise device, including a recumbent exercise bicycle, as shown, or any of the others disclosed herein. The frame or support structure can have a support arm 2258 that can be used to support a pair of resilient member support elements 2254. This is a more integrated design, in which the frame of the secondary exercise device has been designed to accommodate the resilient member support elements. The frame can be strengthened such that the frame can remain strong, robust, and rigid even when significant loads are exerted by the resilient members 2256 on the resilient member support elements and frame 2252.

When the frame is designed to support the resilient member support elements, it may be important to increase the strength of the frame to accommodate the additional forces exerted on the frame, and also to position the resilient member support elements in an ideal position so that the movement of the resilient member will not be hindered or substantially hindered by the components of the secondary exercise device. For example, as shown, the frame can be configured such that the resilient member support elements are positioned laterally of the pedals of the recumbent bike so that neither the pedals nor the user's feet or legs strike the resilient members when the secondary exercise device and the resilient members are being used simultaneously, or at least such that the risk of that occurring is reduced. Additionally, the resilient member support element can each be positioned at a forward end of the frame structure so that a user can perform pushing exercises with the resilient members or pulling exercises with the resilient members. FIG. 8 illustrates pulling exercises being performed with the resilient members while simultaneously exercising the user's lower body and cardiovascular system with the secondary exercise device.

As shown, the exercise system 2250 can have a pair of resilient member support elements 2254*a* that are positioned laterally of the secondary exercise device. Additionally, with reference to FIG. 8, the resilient member exercise device can also have a third or forward positioned resilient member support elements 2254*b* position to the front of the secondary exercise device. In this arrangement, the forward positioned resilient member support element 2254*b* is not positioned in a location that is usable by the user of the secondary exercise device, in most cases. However, the forward position resilient member support element 2254*b* is positioned at the location where a user standing to the front of the resilient member exercise device can engage a resilient member supported by the forward position resilient member support element 2254*b* to provide a station for performing ground-based exercises by either a single user or by multiple users working out in the circuit fashion. In this configuration, the system provides an enhanced and beneficial cross training device for a single user or a small group of users to utilize. The exercises that can be performed using the four position resilient member support elements in any embodiments disclosed herein can be the same as or different than the exercises that can be performed using the laterally positioned resilient member support elements.

The resilient member support elements can have any of the same features, details, or other configurations of any of the resilient member support elements disclosed or incorporated by reference herein. The arcuate shaped resilient member support elements of system 2250 can each have two rows of holes, with angles varying by approximately 22° within each row. Each of the holes in the outermost row of holes also varies by 22°, and the entire outermost row of holes can each be positioned at a 17° angle relative to the adjacent hole of the innermost row of holes so that, when the resilient member is placed in the outermost holes, the resilient member will have approximately a 17° angle relative to resilient member placed in the adjacent hole of the innermost row of holes.

FIGS. 9-12 illustrate another embodiment of a resistance based exercise system 2300, having resilient member support elements 2304 and the supporting frame therefor integrated with the frame or support structure F of the secondary exercise device S.

The exercise system 2300 has a secondary exercise device S and base member 2302 that can be bolted to the frame or support structure of the secondary exercise device S, or can be formed integrally with the support structure of the secondary exercise device. The base member 2302 can have any of the same features, components, materials, or other details of any of the other exercise system or base member embodiments disclosed herein. In any embodiments, such as in the illustrated embodiment, the base member 2302 can support two or more resilient member support elements that can each have a plurality of openings configured to removably support an end portion of any of a variety of resilient members. Additionally, in any embodiments disclosed herein, the exercise system can have a third resilient member support element (not shown) positioned near a middle portion of the base member 2302, which can be positioned forward of the secondary exercise device. In the illustrated embodiment, the secondary exercise device S is a recumbent exercise bicycle. However, as with any of the embodiments disclosed herein, the secondary exercise device can be any of a wide range of the exercise device is disclosed or described above, including recumbent stepper devices, upright exercise bikes, upright stepping devices, lateral trainers, elliptical devices, or otherwise.

The resilient member support elements 2304 can be supported by the base member 2302 in a position such that a user using the secondary exercise device can also operate and use the resilient members in any of a range of positions. The resilient member support elements can have any number of openings therein, such as between five or six openings in each of the two rows of openings formed in the resilient member support elements. The base member 2302 can be configured to bolt onto the existing frame or support structure of the secondary exercise device, or can be integrated into the design of the frame or support structure of the secondary exercise device such that the structure needed for the resilient member support elements can be formed or manufactured at the same time that the rest of the support elements of the frame or support structure for the secondary exercise device are formed.

The base member of the exercise system 2300 can be designed to fit around the existing structure or frame F or other components or features of the secondary exercise device. In any embodiments disclosed herein, the exercise system can be configured such that a user can use the resilient members while simultaneously using the secondary exercise device. Additionally, any embodiments of the exercise systems disclosed herein can also be configured such that a user can use the resilient members from a standing position adjacent or away from the secondary exercise device. For example, with reference to FIG. 9, a user can stand on a ground surface adjacent to a forward end **2300*a* of the exercise system can perform exercises by bending the resilient member is positioned in any one of the resilient member support elements of the exercise system. A user can bend the resilient member 2306 removably supported by a middle or third resilient member support element 2304 that is positioned forward of the secondary exercise device and near or at a middle portion of the base member 2302, thereby providing an additional exercise station apart from the station occupied by a user of the secondary exercise device. Additionally, as mentioned, the laterally positioned resilient member support elements can accommodate users standing, kneeling, or sitting to the side of the exercise device 2300**. These additional capabilities not present in similar devices on the market can increase the versatility and usability of the device, and also allow multiple people to use the exercise system simultaneously.

In any embodiments disclosed herein, the base member 2302 can have a substantially planar top surface 2350 that can also be used to conceal or cover the components of the frame of the base member 2302. The planar surface 2350 can also be used to support instructional and/or branding graphics, such as indexing letters and numerals to help identify hole positions for the resilient members, as desired.

As mentioned, the exercise system 2300 can have any of the features, shapes, components, materials, or other details of any of the embodiments of the exercise systems or resilient member supports in this disclosure or incorporated by reference herein. Similarly, the resilient members can have any of the features, shapes, components, materials, or other details of any of the embodiments of the resilient members disclosed in this disclosure or incorporated by reference herein.

Any exercise system embodiment disclosed herein can be configured to be positioned under and bolted or otherwise fastened to the secondary exercise device or a portion thereof and can be configured such that the weight of the secondary exercise device or portion thereof that is positioned on top of the base member can be used to stabilize the base member when the resilient members are being used, in addition to the fastening elements used to couple the base member to the secondary exercise element. In this configuration, the base member and resilient members can be used with any existing secondary exercise device without modification of the secondary device or components thereof. In any embodiments disclosed herein, the resilient member supports can be positioned on the base member such that, when a secondary exercise element is positioned on top of the base member, the resilient member support elements can be positioned laterally outside of the structure of the secondary exercise device.

Figure 13:
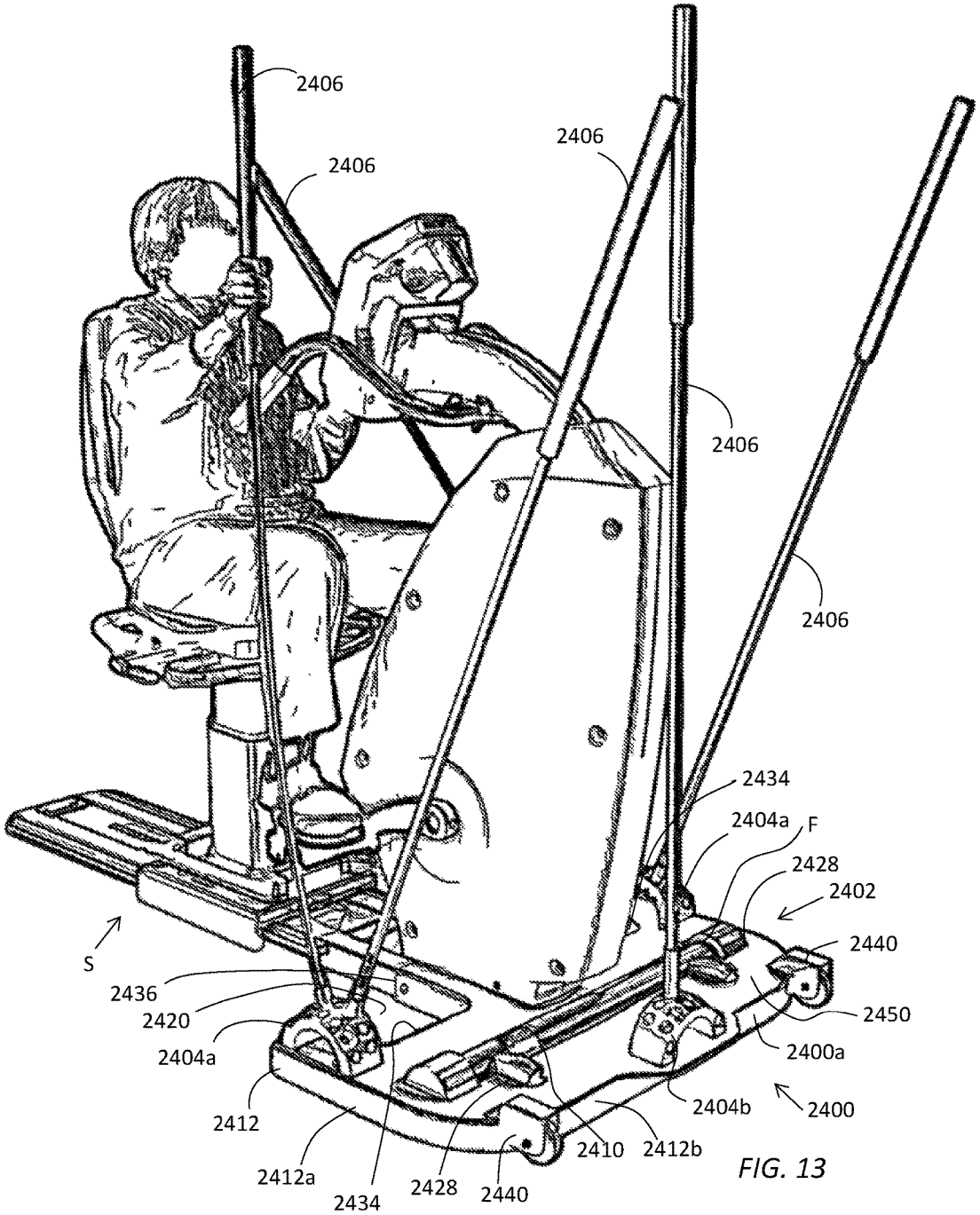
FIG. 13 is a perspective view of another embodiment of a resistance based exercise system, having resilient member support elements and the supporting frame therefor attached to a frame or support structure of a secondary exercise device.
Figure 14:
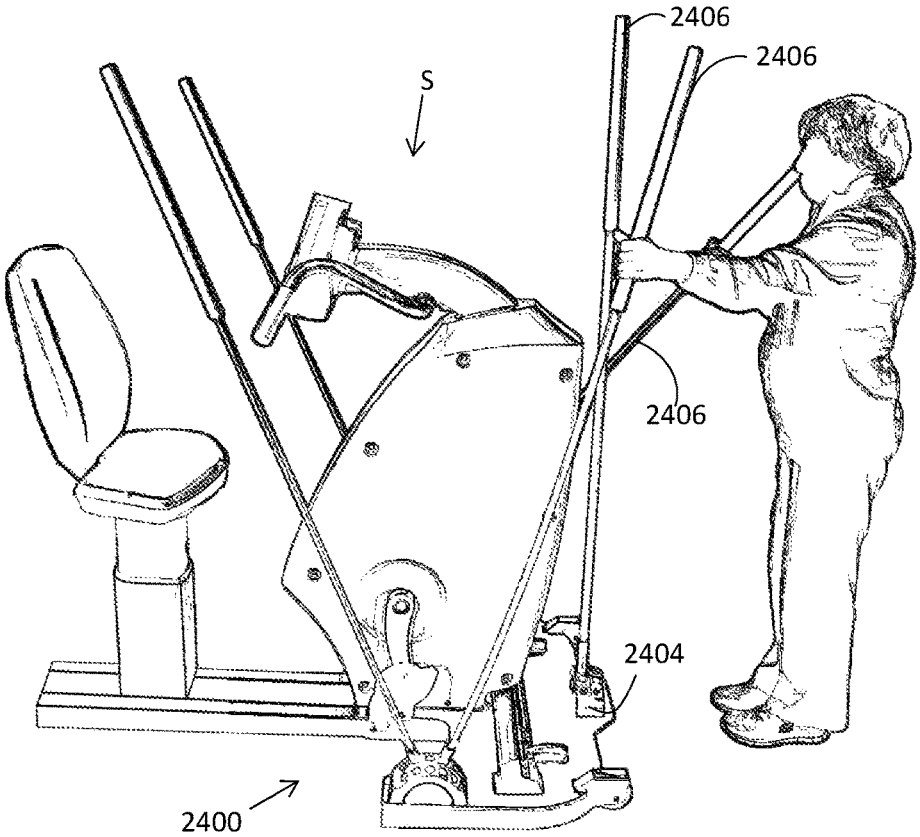
FIG. 14 is a side view of the embodiment of the resistance based exercise system shown in FIG. 13, showing a user using the system from a ground based position in front of the res.
Figure 15:
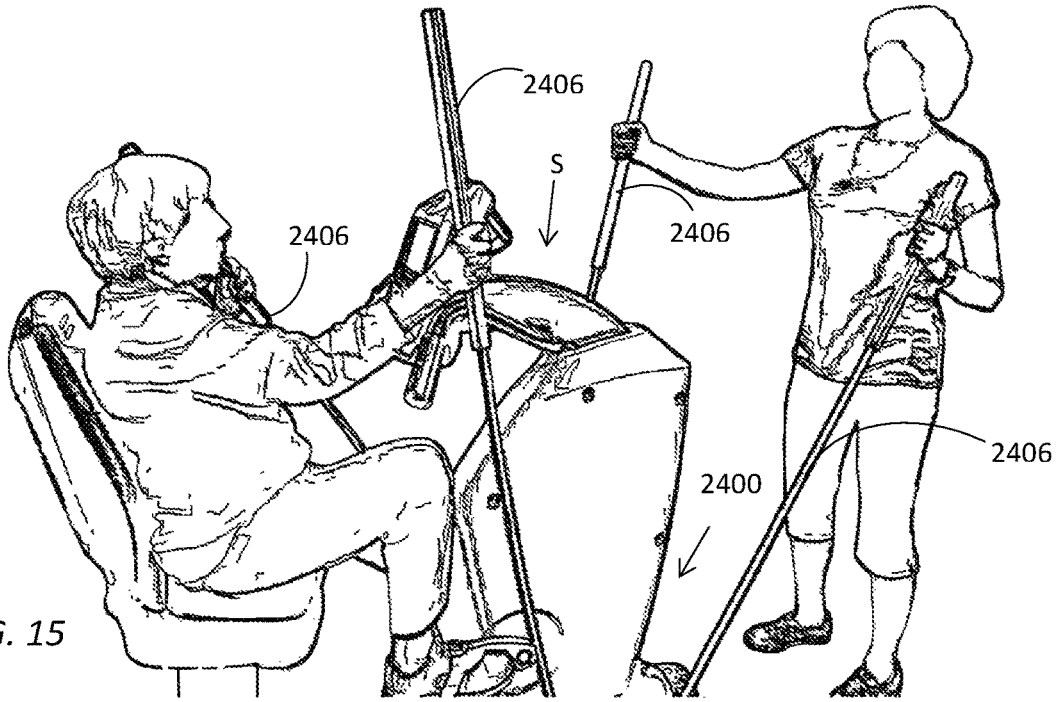
FIG. 15 is a side view of the embodiment of the resistance based exercise system shown in FIG. 13, showing a user using the system from a ground based position in front of the resistance based exercise system and a user using the system simultaneously while using the embodiment of the secondary exercise device shown.

FIG. 13 is a perspective view of another embodiment of a resistance based exercise system 2400, having resilient member support elements and the supporting frame therefor attached to a frame or support structure F of a secondary exercise device S. FIG. 13 illustrates a user independently bending the resilient members 2406 while simultaneously operating the secondary exercise device. FIG. 14 is a side view of the embodiment of the one shown in FIG. 13, showing a user using the system 2400 from a ground based position in front of the res. FIG. 15 is a side view of the embodiment of the resistance based exercise system shown in FIG. 13, showing a user using the system 2400 from a ground based position in front of the resistance based exercise system and a user using the system 2400 simultaneously while using the embodiment of the secondary exercise device shown.

The resistance based exercise system 2400 can have a base member 2402 that can be coupled with or attached to (such as with bolts or other fasteners) to an existing frame structure F of a secondary exercise device S. In the illustrated embodiment, the secondary exercise device is a recumbent bicycle. However, the secondary exercise device can be any one of the examples of a secondary exercise device listed above. The base member 2402 can have any of the same features, components, materials, or other details of any of the other exercise system or base member embodiments disclosed herein. In any embodiments, such as in the illustrated embodiment, the base member 2402 can support two or more resilient member support elements that can each have a plurality of openings configured to removably support an end portion of any of a variety of resilient members. Additionally, in any embodiments disclosed herein, the exercise system can have a third resilient member support element 2404*b* positioned near a middle portion of the base member 2402 and, as shown, can be positioned forward of the secondary exercise device to enable a user standing in front a front edge 2400*a* of the base member 2400 to exercise using one or more resilient members, as shown in FIGS. 14 and 15. The user standing in front of the exercise device can utilize resilient members supported by the laterally positioned resilient member support elements 2404*a* or the resilient member support element positioned adjacent to the front edge 2400*a* of the base member (i.e., in front of the secondary exercise device). Additionally, as shown in FIG. 15, a user can exercise using one or more resilient members 2406 supported by the resilient member support element 2404*b* positioned forward of the secondary exercise device at the same time the user using the secondary exercise device uses one or more of the resilient members supported by other resilient member support elements 2404 of the base 2402. This is the great advantage of allowing multiple users to use the device simultaneously, and or permitting multiple uses of the same device by one or more users working out in a circuit fashion.

In the illustrated embodiment, the secondary exercise device S is a recumbent exercise bicycle. However, as with any of the embodiments disclosed herein, the secondary exercise device can be any of a wide range of the exercise device is disclosed or described above, including recumbent stepper devices, upright exercise bikes, upright stepping devices, lateral trainers, elliptical devices, or otherwise.

As mentioned, the resilient member support elements 2404*a* positioned laterally of the secondary exercise device S can be supported by the base member 2402 in a position such that a user using the secondary exercise device can also operate and use the resilient members in any of a range of positions. The resilient member support elements can have any number of openings therein, such as between five or six openings in each of the two rows of openings formed in the resilient member support elements. The base member 2402 can be configured to bolt onto the existing frame or support structure of the secondary exercise device, or can be integrated into the design of the frame or support structure of the secondary exercise device such that the structure needed for the resilient member support elements can be formed or manufactured at the same time that the rest of the support elements of the frame or support structure for the secondary exercise device are formed.

The base member of the exercise system 2400 can be designed to fit around the existing structure or frame F of the frame of the secondary exercise device. For example, one or more openings 2410 can be formed in the base member 2402 to fit over or around the existing support structure F of the secondary exercise device S.

In any embodiments disclosed herein, the base member can have a first support member 2412 having two side portions 2412*a* of the front portion 2412*b*. Each of the side and middle portions of the first support member 2412 can support a resilient member support element thereon or therewith. For example, in any embodiments disclosed herein, the resilient member support element can be attached to the side portions and the front portion of the first support member 2412 using bolts. Four or six bolts can be used to secure each of the resilient member support elements to the base member 2402.

The base member can be configured to couple with the existing frame structure S2 using the existing bolt holes, bosses, and other attachment elements. In some embodiments, the base member 2402 can have one or more support or frame members configured to engage with one or more portions of the frame structure F to provide additional support and securement of the base member 2402 to the frame or support structure S2. For example, the base member 2402 can have a first and a second support member that can engage with the wheel housings 2428 of the frame structure F of the secondary exercise device to provide additional strength and support to the exercise system 2400 during use of the resilient members, particularly during use of the resilient members supported by the resilient member support element positioned at a forward end of the base member 2402.

The base member 2402 can also have first and second lateral support members 2434 to provide additional support to make the base member 2402 more rigid and robust to counteract any forces exerted on the base member and prevent deflection of the base member 2402 one forces are exerted on the laterally positioned resilient member support elements during use of the resilient members. The lateral support members 2434 also provide an additional connection point between the existing support structure F and the first support member 2412. The lateral support members 2434 can be coupled with bolt support members 2436, which can be bolted directly to a frame portion of the secondary exercise device.

Wheel support housings 2440 can also be coupled with, affixed to, or supported by the first support member 2412. The wheel support housings can support wheels 2442 therein to permit the exercise system 2400 to be easily move rolled or moved for relocation and/or storage purposes, even with the base member 2402 attached to the secondary exercise device S. The base member 2402 can have a substantially planar top surface 2450 that can also be used to conceal or cover the components of the frame of the base member 2402. The planar surface 2450 can also be used to support instructional and/or branding graphics, such as the indexing letters and numbers used to identify the various holes in the resilient member support elements 2404.

Additionally, the base member 2402 can be configured to have a recess or openings 2420 positioned adjacent to where user's foot may travel or move during operation of the secondary exercise device. The recesses 2420 can be sized and configured such that the base member 2402 does not inhibit or obstruct the free movement of the user using the secondary exercise device. For example, when a secondary exercise device is a recumbent bicycle, the recesses or openings 2420 can provide a clear space for the pedals or a user's feet to travel during operation of the pedal or crank assembly of the exercise bike. Additionally, positioning the resilient member support elements near the lateral sides of the base member 2402 can reduce the likelihood that the resilient members may obstruct the free movement and operation of the pedals, foot beds, or other components of the secondary exercise device. For example, when the resilient member support elements are positioned laterally outside the furthest width of the pedals of the secondary exercise device, resilient members positioned or supported by the resilient member support elements will be less likely to obstruct or come into contact with the pedals during operation of the exercise system 2400.

As mentioned, the exercise system 2400 can have any of the features, shapes, components, materials, or other details of any of the embodiments of the exercise systems or resilient member supports in this disclosure or incorporated by reference herein. Similarly, the resilient members can have any of the features, shapes, components, materials, or other details of any of the embodiments of the resilient members disclosed in this disclosure or incorporated by reference herein.

Any exercise system embodiment disclosed herein can be configured to be positioned bolted or otherwise fastened to the secondary exercise device or a portion thereof and can be configured such that the weight of the secondary exercise device or portion thereof that is coupled with the base member of the resistance based exercise system can be used to stabilize the base member when the resilient members are being used by a user standing, sitting, kneeling, lying, or otherwise positioned off of the secondary exercise device. In this configuration, the base member and resilient members can be used with any existing secondary exercise device with little to no modification of the secondary device or components thereof. In any embodiments disclosed herein, the resilient member supports can be positioned on the base member such that, when a secondary exercise element is positioned on top of the base member, the resilient member support elements can be positioned laterally outside of the structure or movement path of the secondary exercise device or components thereof.

Figure 16:
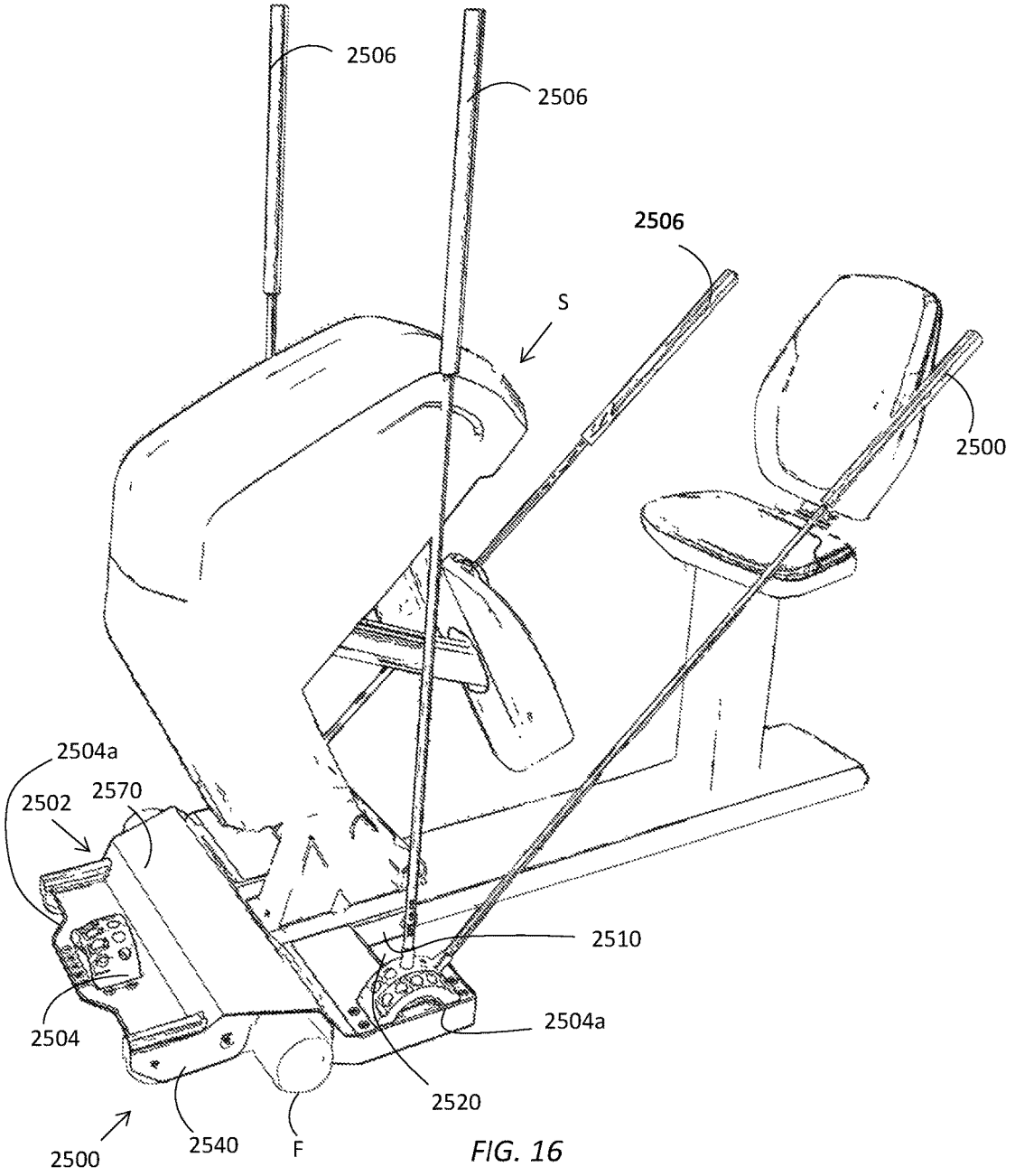
FIG. 16 is a perspective view of another embodiment of a resistance based exercise system, having resilient member support elements and the supporting base member therefor attached to a frame or support structure of a secondary exercise device.
Figure 17:
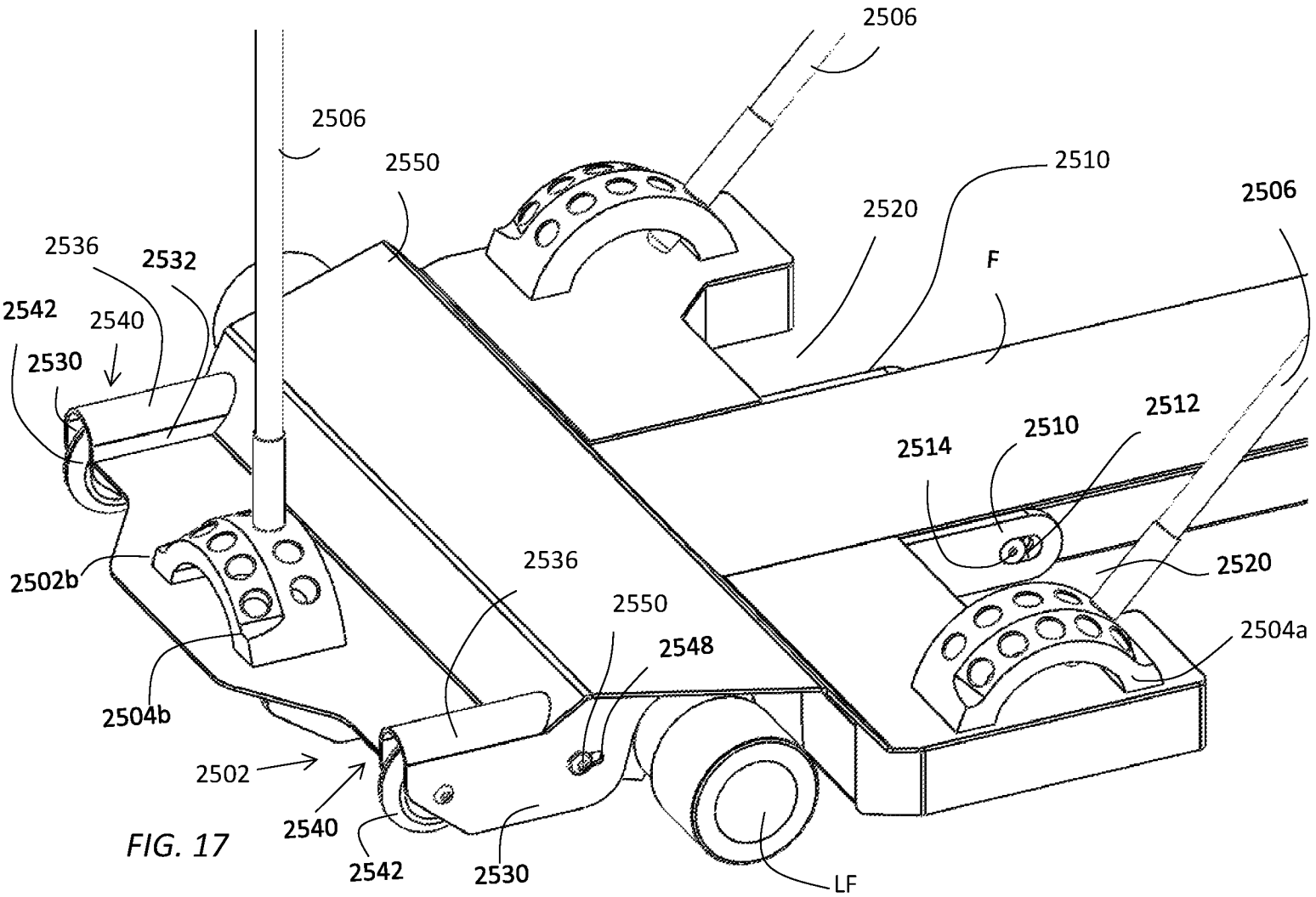
FIG. 17 shows a top portion of the base member of the embodiment of the resistance based exercise system of FIG. 16, with portions of the secondary exercise device being removed for clarity.
Figure 18:
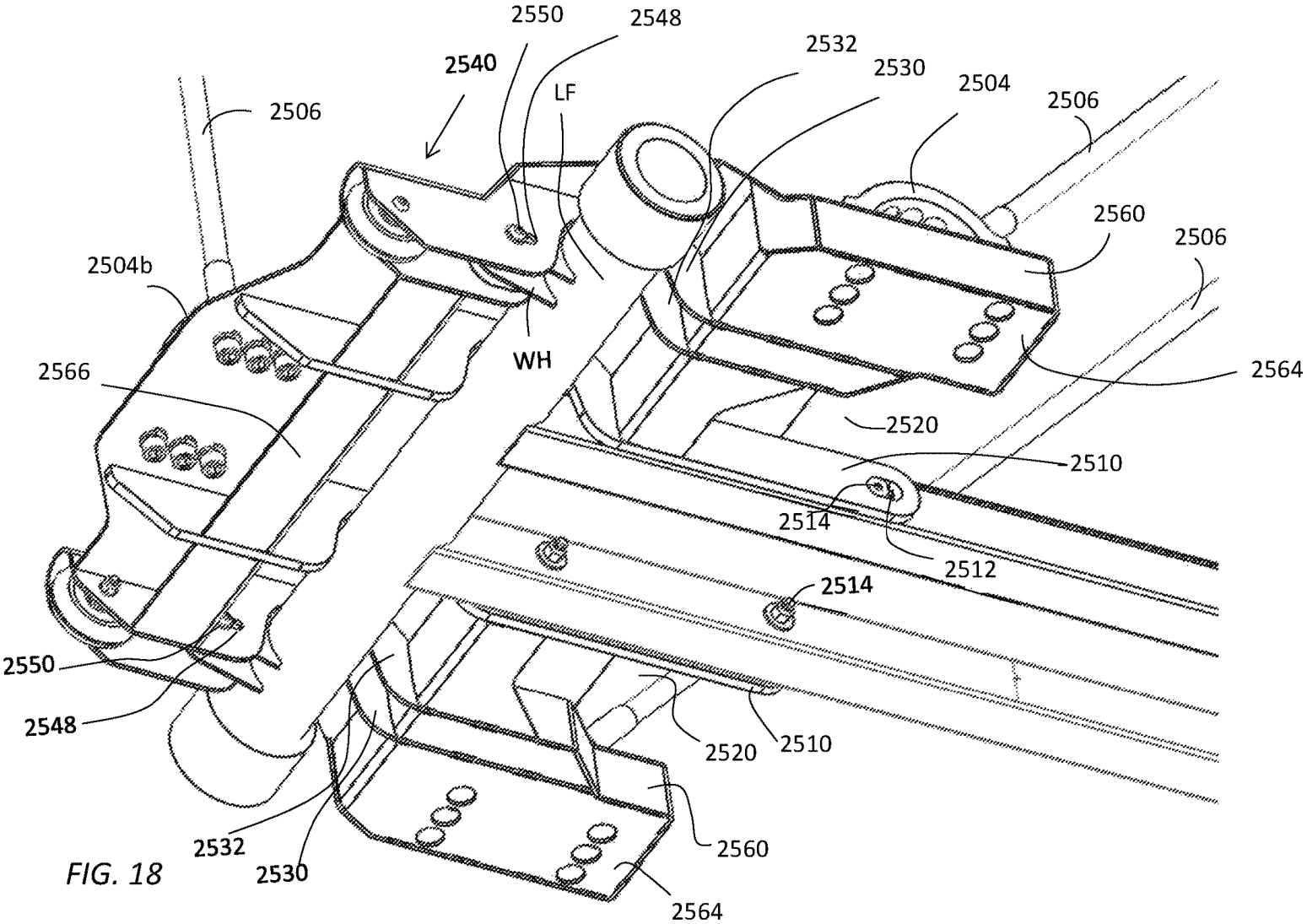
FIG. 18 shows a bottom portion of the base member of the embodiment of the resistance based exercise system of FIG. 16, with portions of the secondary exercise device being removed for clarity.
Figure 19:
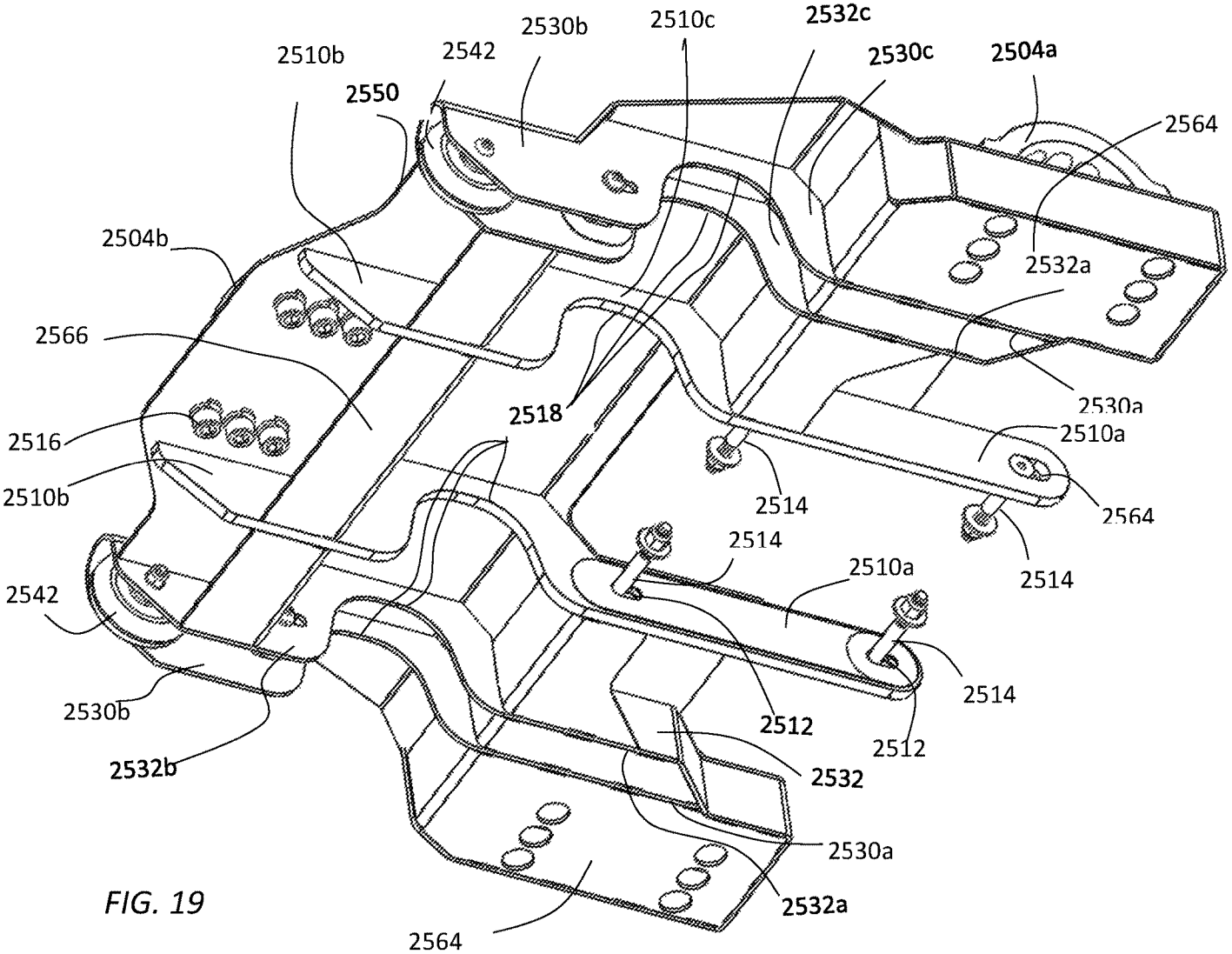
FIG. 19 is a perspective view of the base member of the embodiment of the resistance based exercise system of FIG. 16, with the secondary exercise device being removed for clarity.
Figure 20:
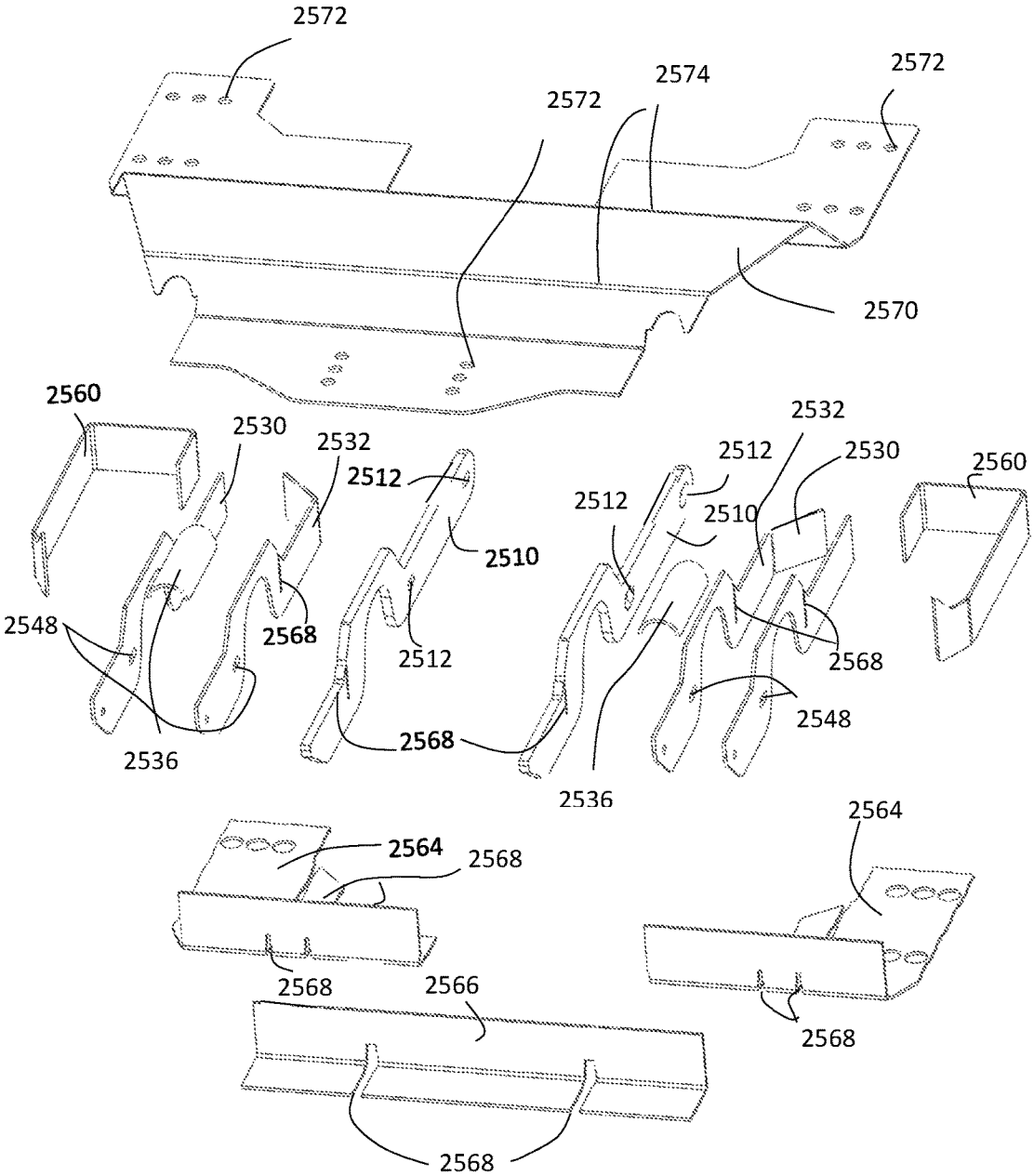
FIG. 20 is an exploded view of the base member of the embodiment of the resistance based exercise system of FIG. 16.

FIG. 16 is a perspective view of another embodiment of a resistance based exercise system 2500, having resilient member support elements 2504 and the supporting base member 2502 therefor attached to a frame or support structure F of a secondary exercise device S. FIGS. 17 and 18 show a top and a bottom portion, respectively, of the base member 2502 of the embodiment of the resistance based exercise system 2500 of FIG. 16, with portions of the secondary exercise device being removed for clarity. FIGS. 19 and 20 are a perspective view and exploded view, respectively, of the base member 2502 with the secondary exercise device being completely removed from the figures for clarity.

Any resistance based exercise system embodiment disclosed herein, including without limitation resistance based exercise system 2500, can be configured to be positioned under and bolted or otherwise fastened to the secondary exercise device or a portion thereof and can be configured such that the weight of the secondary exercise device or portion thereof that is position on top of the base member or attached to the base member of the resistance based exercise system can be used to stabilize the base member when the resilient members are being used. In this configuration, the base member and resilient members can be used with any existing secondary exercise device with little to no modification of the secondary device or components thereof. Alternatively, the resistance based exercise system embodiments disclosed herein can be configured such that the base member is integrally formed with the frame or other support elements of the secondary exercise device, for a more streamlined and uniform overall device.

In any embodiments disclosed herein, the exercise system can be configured such that a user can use the resilient members while simultaneously using the secondary exercise device. Additionally, any embodiments of the exercise systems disclosed herein can also be configured such that a user can use the resilient members from a standing position adjacent or away from the secondary exercise device. For example, a user can stand on a ground surface adjacent to a forward end 2500*a* of the exercise system can perform exercises by bending the resilient member is positioned in any one of the resilient member support elements of the exercise system. For example, a user can then the resilient member 2506 removably supported by a middle resilient member support element 2504*b* that is positioned forward of the secondary exercise device and near or at a middle portion of the base member 2502. This can increase the versatility and usability of the device, and also allow multiple people to use the exercise system simultaneously.

In any embodiments disclosed herein, the resilient member supports can be positioned on the base member such that, when a secondary exercise element is positioned on top of the base member or is attached to the base member, the resilient member support elements can be positioned laterally outside of the structure of the secondary exercise device so that the secondary exercise device can be used without obstruction by the resilient members and so that the resilient members can be used without obstruction by the components of the secondary exercise device or by the user of the secondary exercise device. In the illustrated embodiment, the secondary exercise device S is a recumbent exercise stepper. However, as with any of the embodiments disclosed herein, the secondary exercise device can be any of a wide range of the exercise device is disclosed or described above, including recumbent exercise devices, upright exercise bikes, lateral trainers, elliptical devices, or otherwise.

In any embodiments disclosed herein, the base member 2502 can have any of the same features, components, materials, or other details of any of the other exercise system or base member embodiments disclosed herein. In any embodiments, such as in the illustrated embodiment, the base member 2502 can support two or more that can each have a plurality of openings configured to removably support an end portion of any of a variety of resilient members 2506. Additionally, in any embodiments disclosed herein, the exercise system can have a third resilient member support element 2504*b* positioned near a middle portion of the base member 2502 and, as shown, can be positioned forward of the secondary exercise device S to increase the versatility of the system, and permit multiple user stations and even multiple simultaneous users on the system.

The resilient member support elements 2504 can be supported by the base member 2502 in a position such that a user using the secondary exercise device can also operate and use the resilient members in any of a range of positions. The resilient member support elements can have any number of openings therein, such as between five or six openings in each of the two rows of openings formed in the resilient member support elements. The base member 2502 can be configured to bolt onto the existing frame or support structure of the secondary exercise device (as illustrated). Some benefits of this design approach are that the base member can be added retroactively to existing secondary exercise devices (i.e., existing secondary exercise devices can be retrofitted with the base member to convert a secondary exercise device into a res). This approach also can be implemented without making changes to the secondary exercise device to accommodate the base member. Alternatively, the base member 2502 can be integrated into the design of the frame or support structure of the secondary exercise device such that the structure needed for the resilient member support elements can be formed or manufactured at the same time that the rest of the support elements of the frame or support structure for the secondary exercise device are formed.

The base member of the exercise system 2500 can be designed to bolt directly to the existing structure or frame F of the secondary exercise device with little to no modification of the structure or frame F of the secondary exercise device. Additionally, to limit the width of the base member 2502 and the resistance based exercise system device overall, the base member can be sized and configured such that the width of the base member can be equal to or less than a width of the secondary exercise device. This will ensure that the width of the overall device will not be greater than a width of the secondary exercise device by itself, which will ensure that the portability and mobility of the device will be preserved as well as it can be (so as to continue to fit through doors, not increase the floor space of the device, etc.). For example and without limitation, in the illustrated embodiment, the base member 2502 can be configured to pass over the lateral frame member LF of the frame F of the secondary exercise device so as to provide support for one or more resilient member support elements positioned at the forward end of the secondary exercise device. The structural support members of the base member 2502 can be configured to extend over any frame members of the secondary exercise device in order extend to or past a forward end of the secondary exercise device to support the one or more resilient member support elements positioned at the forward end of the base member 2502. This will provide one or more additional exercise stations at the forward end of the secondary exercise device for users standing, sitting, kneeling, lying, or otherwise positioned on the ground surface forward of the secondary exercise device.

With reference to FIGS. 16-18, the base member 2502 can be configured to couple with the existing frame structure S2 using the existing bolt holes, threaded bosses, and other attachment elements of the secondary exercise device.

As shown, the base member 2502 can have one or more first frame members 2510 configured to provide a main attachment point with one or more portions of the frame structure F of the secondary exercise device to secure the base member 2502 to the frame or support structure F. The first frame members 2510 can be sufficiently rigid to provide structural support to the base member and provide a secure and rigid connection point between the base member and the frame F of the secondary exercise device. The first frame members 2510 can have one or more openings 2512 (which can be, but are not required to be, slotted for lengthwise adjustability of the base member) positioned and a first portion 2510*a* of the first frame members 2510 through which a bolts 2514 can extend to engage with the frame member F of the secondary exercise device. In the illustrated embodiment, there are two first frame members 2510 each having to slotted openings 2512 through which bolts can extend to couple the base member 2502 to the frame F of the secondary exercise device. However, any desired number of openings and fasteners can be used to secure the first frame members and the base member to the secondary exercise device.

As illustrated, the first frame members 2510 can also extend in a forward direction to provide structural support to a forward portion 2502*b* of the base member 2502 and a resilient member support element 2504*b* supported by the forward portion 2502*b* of the base member, forward of the secondary exercise device S. Because the frame structure F of the secondary device has a lateral frame member LF, and because in this embodiments it may be desired to not extend laterally outwardly around the lateral frame member LF (which would increase a width of the overall device), the first frame members 2510 can be designed to extend over the lateral frame member LF to provide structural rigidity and support to the forward portion 2502*b* of the base member 2502. To satisfy this design objective, the first frame members 2510 can have a middle portion 2510*c* that has an overall height that is greater than a height of the lateral frame member LF of the secondary exercise device. This greater height of the middle portion 2510*c* can increase the rigidity and provide a connection between the first portion 2510*a* and the forward portion 2510*b* of the first frame members 2510.

An opening or recess 2518 can be formed in the middle portion 2510*c* of the first frame members 2510 at a size and shape configured to receive or extend over and around the lateral frame member LF of the secondary exercise device. Additionally, the recess 2518 can be sized such that the base member 2502 can be moved into forward or aft direction relative to the structure or frame F of the secondary exercise device to permit adjustability of the position of the resilient member support elements 2504 relative to the secondary exercise device or relative to a user using the secondary exercise device. The recess 2518 formed in any of the frame members can be sized to provide space in the forward and aft direction relative to the lateral frame member LF of the secondary exercise device so that there is a gap between the lateral frame member LF and the recess 2518 sufficiently large enough to provide for the desired amount of adjustability of the base member 2502 in the forward and aft directions relative to the frame F of the secondary exercise device S.

The base member 2502 can also have a pair of first lateral support members 2530 and a pair of second lateral support members 2532. The rear portion of the first lateral support members 2530 can be used to support and provide additional structural rigidity to the base member 2502 to provide structural rigidity and support to the resilient member support elements 2504. The first and second lateral support members 2530 and 2532 can also have an increased height in a middle portion 2530*c*, 2532*c*, respectively, thereof for additional rigidity and strength between the forward and rearward sections of the lateral support members 2530, 2532. A recess 2518 can be formed in a middle portion 2530*c*, 2532*c*, respectively, of the first and second lateral support members 2530, 2532 to enable the first and second lateral support members 2530, 2532 two extend beyond the lateral frame member LF of the secondary exercise device.

A forward portion 2530*b* of the first lateral support member 2530 and a forward portion 2532*b* of the second lateral support member 2532 can support a wheel housing cover member 2536 to provide wheel housings 2540 at a forward and 2502*b* of the base member 2502. Wheels 2542 can be supported within the wheel housings 2540 to provide increased portability and maneuverability of the exercise device. The wheels can be positioned at a forward end of the base member 2502 such that, when a user lifts the rear end of the entire exercise device, the wheels 2542 will contact the ground surface or engage the ground surface and support the weight of the front end of the exercise device and allow the user to move in maneuver the exercise device by rolling the exercise device on the wheels 2542.

Additionally, the first and second lateral support members 2530, 2532 can be used to secure a forward portion 2502*b* of the base member 2502 to the frame F of the secondary exercise device. For example, in the illustrated embodiment, the frame of the secondary exercise device has a wheel housing WH (shown most clearly in FIG. 18) that can be used as an attachment point for the base member to provide a more rigid and secure connection for a forward portion 2502*b* of the base member 2502. For example and without limitation, threaded fasteners or other suitable fasteners can be passed through openings 2548 formed in the first and second lateral support members to engage one or more openings formed in the wheel housing WH of the secondary exercise device to provide an additional connection point (that can be removable) to the frame or support structure F of the secondary exercise device S. providing these additional securement points can substantially increase the overall rigidity of the base member 2502, and particularly the forward portion 2502*b* of the base member when the forward positioned resilient member support elements 2504*b* is being used. The openings 2548 can be slotted also to enable forward and aft movement and adjustability of the base member 2502 relative to the frame. Rubber pads another surface protection items can be positioned on the frame F or on adjacent surfaces of the base member 2502 to prevent the scuffing or scratching of the surface of the frame and the base member.

The base member 2502 can also have additional support members or frame members 2560 and 2564 to provide additional support to make the base member 2502 more rigid and robust to counteract any forces exerted on the base member and prevent deflection of the base member 2502 when forces are exerted on the laterally positioned resilient member support elements during use of the resilient members. The support members 2560 can increase the rigidity of the base member 2502 in bending and also in torsion to ensure that the resilient member support elements are firmly and rigidly supported during use of the resilient members 2506. The support members 2560 and all other frame members disclosed herein can be formed by laser cutting from sheet metal, and can be bent using standard metal forming techniques or sheet metal bending techniques to the desired or shape.

The frame members 2564 can have a bent portion to increase the overall stiffness of the frame member and can be welded to the frame members 2560 to provide a rigid and torsionally stiff box structure to increase the overall stiffness of the base member 2502. Additionally, the frame member 2566 can be positioned in the forward portion of the base member 2502 to provide additional lateral stiffness and interconnectivity between the various frame members in the forward portion of the base member. The frame member 2566 can also be bent to provide additional strength and rigidity to the base member. Slots 2568 can be formed in one or more of the members, such as is shown in the figures, to enable the assembly and interconnectivity of the various frame members and also increase the structural rigidity of the overall frame structure by increasing the connection point between the various frame members.

A cover member 2570 can be formed to fit over a top of the structure comprised of the frame members to further increase the rigidity of the overall base member 2502 and to provide a surface against which the resilient member support elements 2504 can be positioned. Bolts can extend through the holes 2572 formed in the cover member 2570 and into the threaded openings of the resilient member support elements 2504 to securely couple the resilient member support elements to the cover member 2570. In any embodiments disclosed herein, the resilient member support elements can be attached to the cover member using four to six or any suitable number of bolts per resilient member support element, six being shown. Locking washers, locking nuts, threadlock, or regular nuts can be used in any of the attachments described in this disclosure.

The cover member can have a contour that matches the desired arrangement of the frame members of the base member 2502. As such, the frame member can have one or more bends 2574 formed therein to follow a profile or contour of the top portion of the frame members 2510, 2530, 2532, of the base member 2502.

All of the frame members can be joined to one another using any suitable techniques, including welding, bolting, brazing, or by using any other suitable fastening techniques. Welds can also be positioned adjacent to the slots to provide for secure connection between the various freight frame members at the slotted connections.

In any embodiments disclosed herein, the height of the base member can be similar to the height of the frame of the secondary exercise device. In the illustrated embodiment, the height of the base member 2502 is approximately 2 inches, not taking into consideration the height of the resilient member support elements 2504 or the height of the base member above the lateral frame member LF of the secondary exercise device.

The base member 2502 can be configured to have a recess or openings 2520 positioned adjacent to where our users the may travel or move during operation of the secondary exercise device, such that the base member 2502 does not inhibit or obstruct the free movement of the user using the secondary exercise device. For example, when a secondary exercise device is a recumbent bicycle, the recesses or openings 2520 can provide a clear space for the pedals or a user's feet to travel during operation of the pedal or crank assembly of the exercise bike.

Additionally, positioning the resilient member support elements near the lateral sides of the base member 2502 can reduce the likelihood that the resilient members may obstruct the free movement and operation of the secondary exercise device. For example, when the resilient member support elements are positioned laterally outside the furthest width of the pedals or foot beds of the secondary exercise device, resilient members positioned or supported by the resilient member support elements will be less likely to obstruct or come into contact with the pedals during operation of the exercise system 2500.

For example and without limitation, in any embodiments disclosed herein, the resilient member support elements can be laterally spaced such that the two resilient member support elements to the sides of the secondary exercise device are spaced apart by approximately 24 inches, or between approximately 23 inches and approximately 26 inches, or between 23 inches and approximately 25 inches. Additionally, the resilient member support elements can be laterally spaced such that the openings of the resilient member support elements in each of the two laterally spaced resilient member support elements to spaced apart by approximately 25.5 inches, from center to center, or from approximately 23 inches to approximately 28 inches, or from approximately 25 inches to approximately 26 inches.

As mentioned, the exercise system 2500 can have any of the features, shapes, components, materials, or other details of any of the embodiments of the exercise systems or resilient member supports in this disclosure or incorporated by reference herein. Similarly, the resilient members can have any of the features, shapes, components, materials, or other details of any of the embodiments of the resilient members disclosed in this disclosure or incorporated by reference herein.

Figure 21:
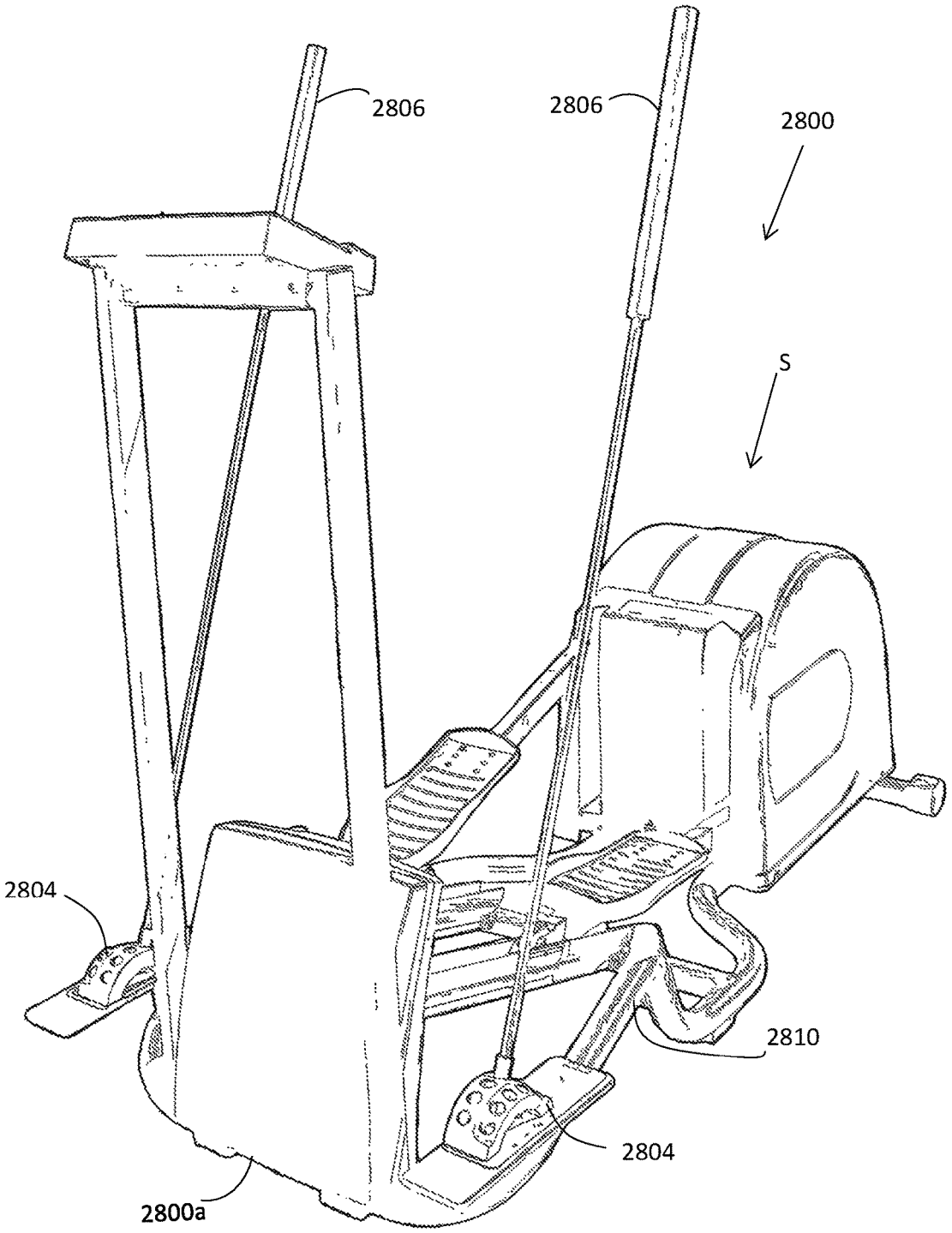
FIG. 21 is a perspective view of another embodiment of a resistance based exercise system wherein the exemplifying secondary exercise device is an upright elliptical machine.
Figure 22:
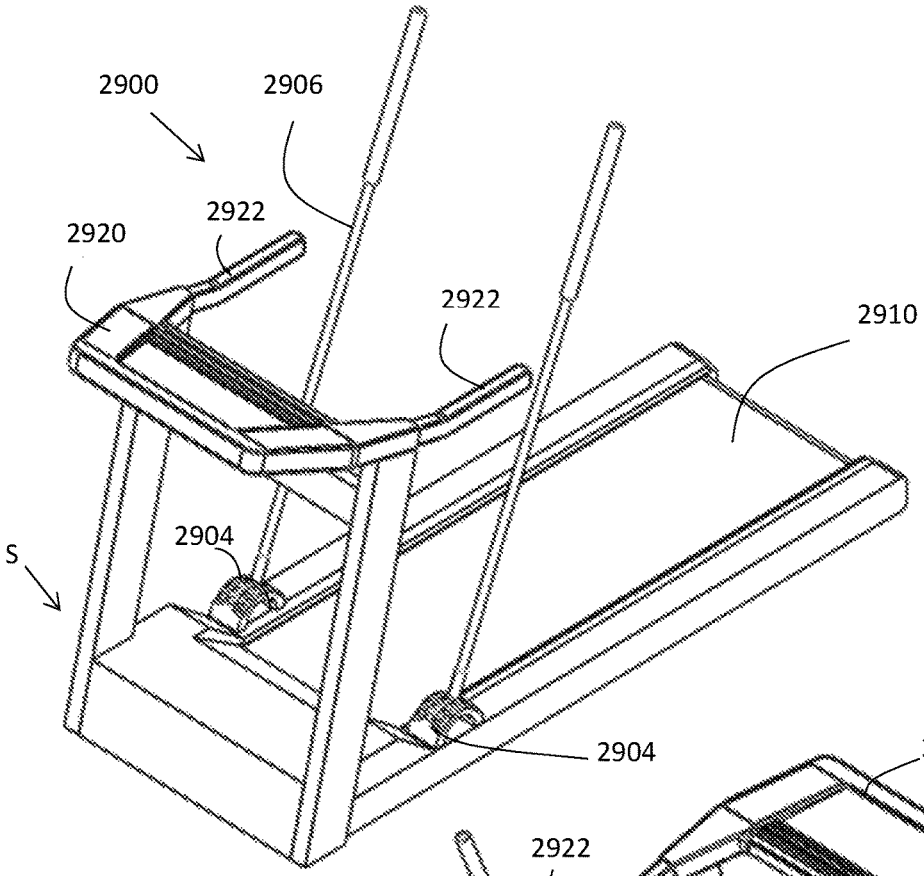
FIG. 22 is a perspective view of another embodiment of a resistance based exercise system wherein the exemplifying secondary exercise device is a treadmill.
Figure 23:
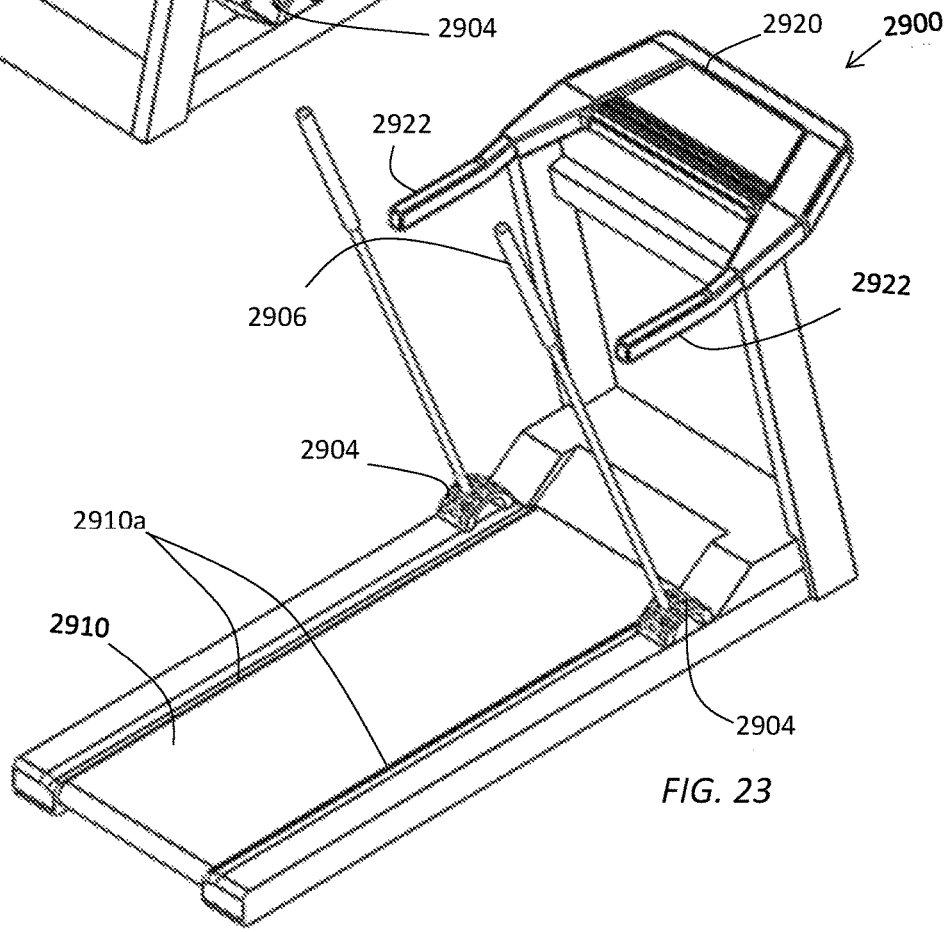
FIG. 23 is another perspective view of the embodiment of the resistance based exercise system shown in FIG. 21.
Figure 24:
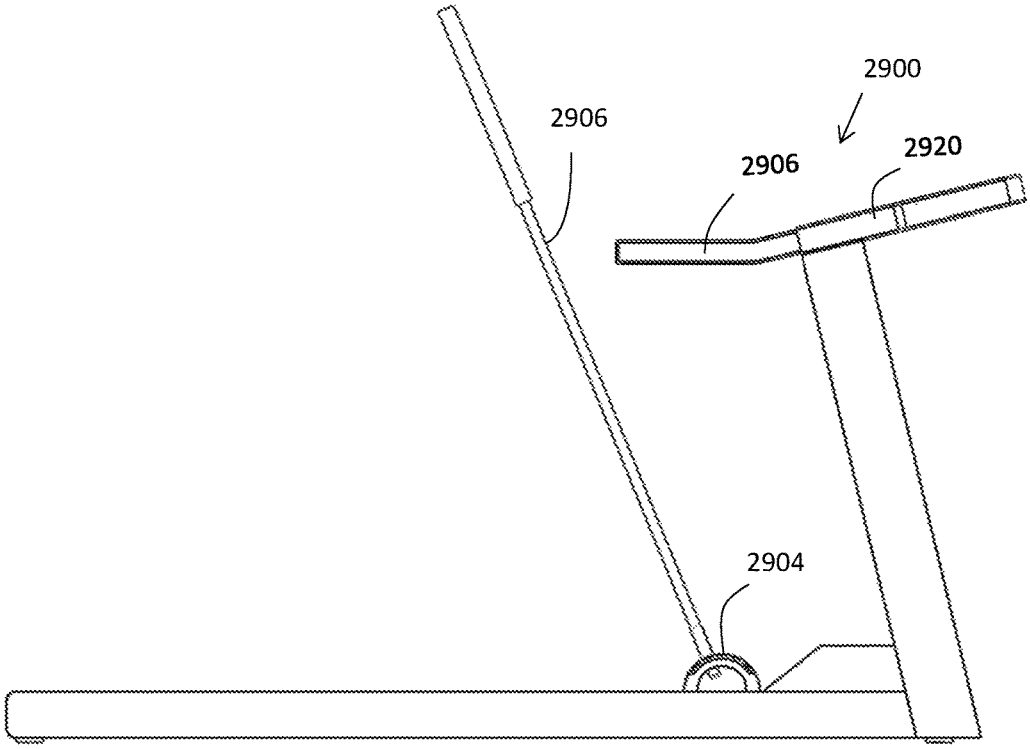
FIG. 24 is a side view of the embodiment of the resistance based exercise system shown in FIG. 21.
Figure 25:
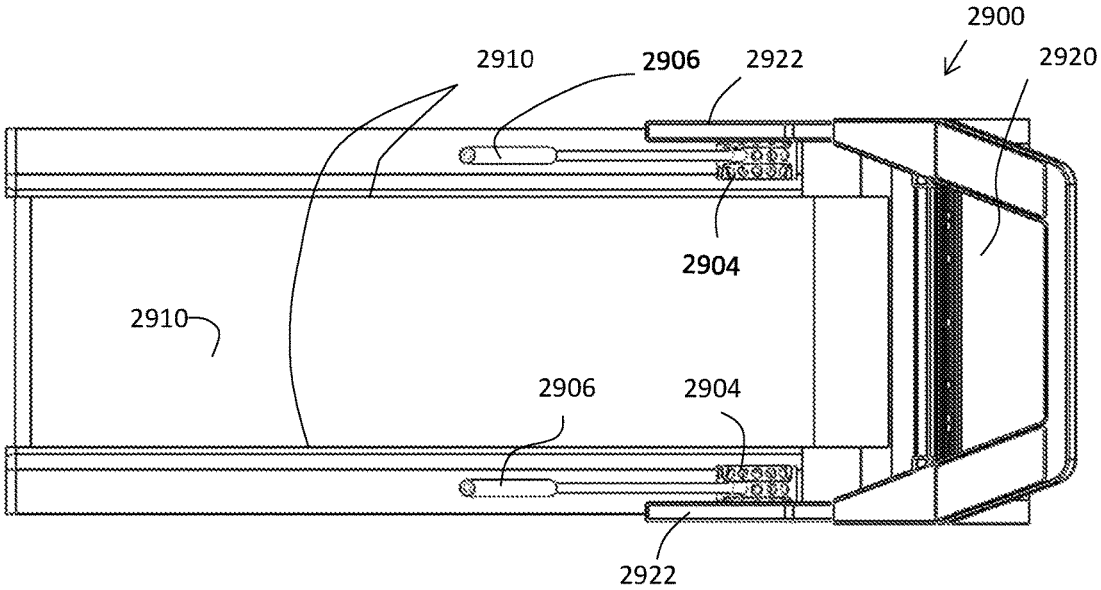
FIG. 25 is a top view of the embodiment of the resistance based exercise system shown in FIG. 21.

FIG. 21 is a perspective view of another embodiment of a resistance based exercise system 2800 where in the exemplifying secondary exercise device S is an upright elliptical machine, but can be any of the secondary exercise device is disclosed herein. The resistance based exercise system 2800 can have two or more resilient member support elements 2804 supported by the frame or structural support 2810 used to support the other components of the elliptical machine. In other words, the structural support for the resilient member support elements 2804 can be integrally formed with the support frame for the elliptical machine.

Additionally, though not shown, one, two, or even three or more resilient member exercise elements can be positioned around any of the embodiments of the secondary exercise device is disclosed herein, including the elliptical machine shown in FIG. 21. For example, similar to the embodiments described above, one, two, or even three or more resilient member support elements 2804 (not shown) can be positioned forward of a front end portion 2800*a* of the resistance based exercise system 2800. The resilient member support element or elements positioned at a forward end of the of the resistance based exercise system can be used by users who are not engaged in the secondary exercise device but who may be standing, sitting, kneeling, or otherwise positioned around the secondary exercise device and the resistance based exercise system, but not directly thereon. For example, seated users are wheelchair users could even roll a wheelchair up to use any of the resilient member support elements disclosed in any of the embodiments herein.

The resistance based exercise system can be used to form multiple exercise stations for one or more users, with each of the exercise stations providing exercise modalities to the user or users. This can be used to support small group training or circuit based workouts.

FIGS. 22-25 are first and second perspective views, a side view, and a top view of another embodiment of a resistance based exercise system 2900 wherein the exemplifying secondary exercise device is a treadmill. The treadmill can have a motor and electronics, or be motorless. As shown therein, one or more resilient member support elements 2904 can be supported by or coupled to one or more components of a treadmill, including the frame or support structure thereof, such that the support structure supporting the resilient member support elements is integral with the frame or support elements used to support the other components of the secondary exercise device, which is a treadmill in this example. A user can exercise one or more muscles of the body using the resilient members while simultaneously exercising his or her body using the treadmill. The treadmill can be any type of treadmill currently on the market, including the curves type treadmills by WOODWAY™ and/or other manufacturers.

As shown in the figures, the resilient member support elements 2904 are preferably positioned laterally away from the lateral edges 2910*a* of the treadmill belt 2910. In this configuration, the resilient member support elements 2904 and at least a bottom portion of the resilient members 2906 will be constrained to a position that will be outside of the space envelope of the treadmill belt so that the resilient member support elements 2904 and at least the free movement of the treadmill belt or substantially obstruct the free movement of a user exercising on the treadmill.

Additionally, though not shown, one, two, or even three or more resilient member exercise elements can be positioned around any of the embodiments of the secondary exercise device is disclosed herein, including the elliptical machine shown in FIG. 21. For example, similar to the embodiments described above, one, two, or even three or more resilient member support elements 2804 (not shown) can be positioned forward of a front end portion 2800*a* of the resistance based exercise system 2800. The resilient member support element or elements positioned at a forward end of the of the resistance based exercise system can be used by users who are not engaged in the secondary exercise device but who may be standing, sitting, kneeling, or otherwise positioned around the secondary exercise device and the resistance based exercise system, but not directly thereon. For example, seated users are wheelchair users could even roll a wheelchair up to use any of the resilient member support elements disclosed in any of the embodiments herein.

Figure 26:
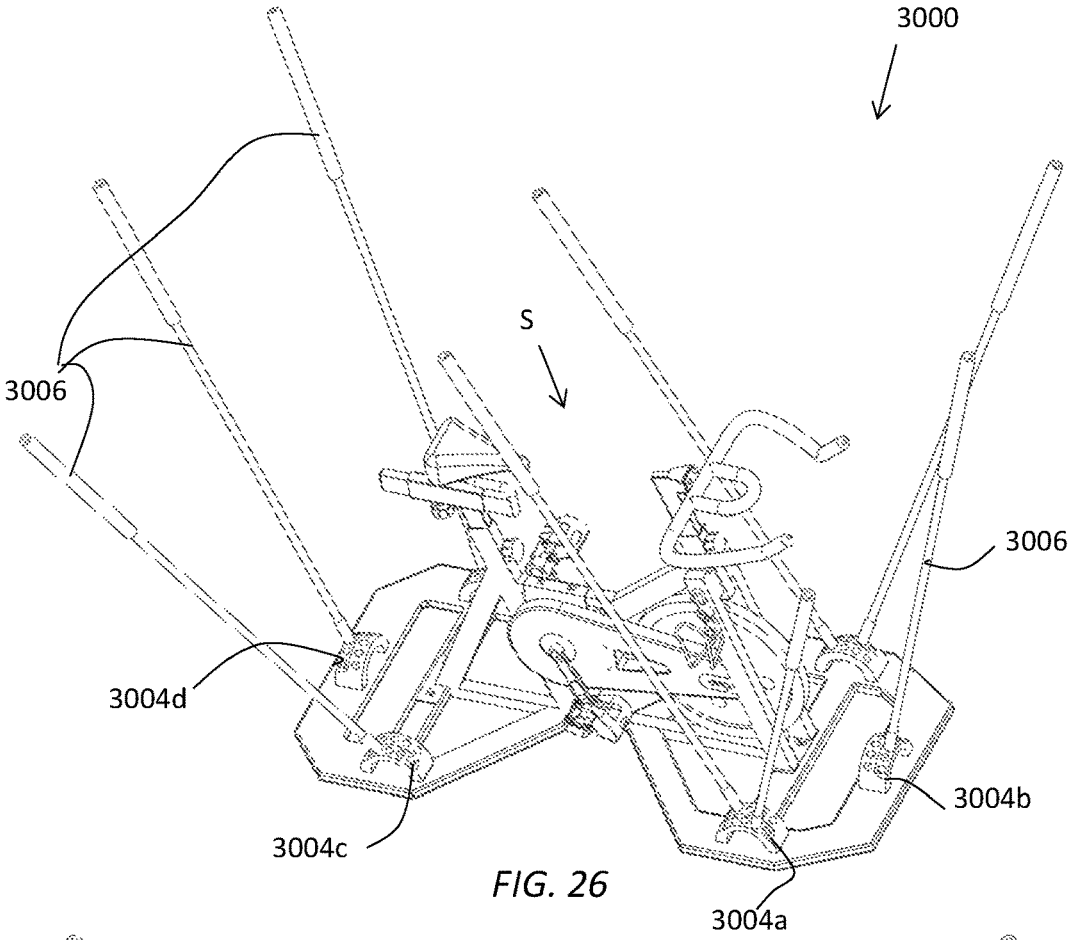
FIG. 26 is a perspective view of another embodiment of a resistance based exercise system wherein the exemplifying secondary exercise device is an exercise bike.
Figure 27:
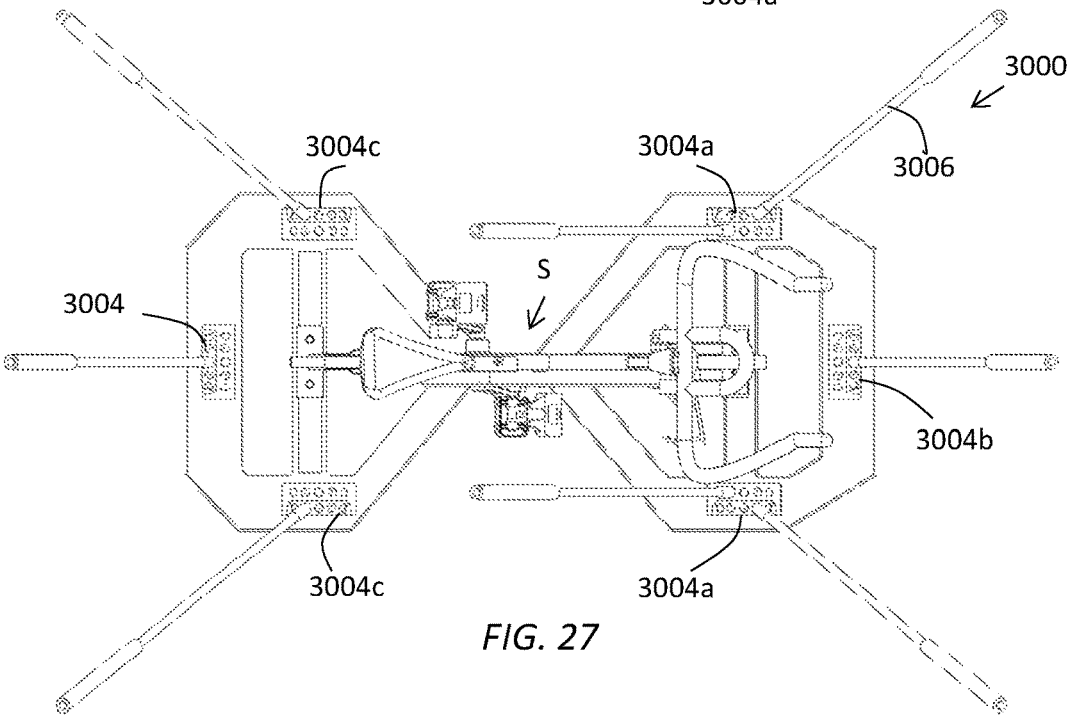
FIG. 27 is a top view of the embodiment of the resistance based exercise system shown in FIG. 25.

Additionally, in any embodiments disclosed herein, including embodiments where the supplemental exercise device is an exercise bike, a treadmill, an elliptical machine, a stepper, or otherwise (whether upright, recumbent, or otherwise), the arcs can be positioned adjacent to a ground surface that supports the exercise device or adjacent to a top surface of a frame member that is supported on the ground or supported on top of footpads or other supports on the ground, as shown for example in FIGS. 26 and 27. FIGS. 26 and 27 are a perspective view and a top view of another embodiment of a resistance based exercise system 3000 wherein the exemplifying secondary exercise device is an exercise bike.

As used herein, in some embodiments, the term adjacent to a ground surface can be used to indicate that a bottom portion of the resilient member support element is within approximately 2 inches of the ground surface. In some embodiments, the term adjacent to a ground surface can be used to indicate that a bottom portion of the resilient member support element is within approximately 2.5 inches, or within approximately 3 inches of the ground surface, or between 2 inches and 4 inches or more of the ground surface.

In other words, to accommodate resilient members that are approximately four feet or five feet long or within this range or any desired length for the user, the resilient member support elements can be positioned near the foot level of the user. For example, in some embodiments, the arcs can be positioned at a location relative to the user that is in proximity to the furthest extension of the user's foot when the user is using the supplemental exercise device. The spatial arrangement and configuration of the resilient member support elements described herein can apply to any of the resistance based exercise devices disclosed herein.

In the illustrated embodiments, the treadmill has a console portion 2920 that can be configured to permit a user to control and operation of the treadmill consistent with the control and operation of current treadmills. One or more handle member's 2922 can extend from the console to provide support to the user on the treadmill. Alternatively, in any embodiments disclosed herein, the handle members can be either reduced in size or removed completely since the resilient members can be used to provide support to the user. Additionally, reducing the size of the console and the handles, or limiting the handles completely, can have the benefit of providing additional range of motion to a user using the treadmill and resilient members so that the resilient members can be bent in any desired direction and to any desired range without being inhibited by the console, handles, or other structure of the secondary exercise device.

Alternatively, in any embodiments disclosed herein, the base member can be configured to be positioned under the secondary exercise device or portion thereof and can be configured such that the weight of the secondary exercise device or portion thereof that is position on top of the base member can be used to stabilize the base member when the resilient members are being used. In this configuration, the base member and resilient members can be used with any existing secondary exercise device without modification of the secondary device or components thereof. In these arrangements, the resilient member support elements can be positioned so as to be laterally outside of the space envelope of the secondary exercise device such that the movement of the resilient members will not be obstructed by the secondary exercise device. For example, if the secondary exercise device is a treadmill, which can have a motor or be motorless (i.e., manually operated), the resilient member supports can be supported by the frame or support structure inherent in the treadmill and can be positioned laterally just to the left and right of the rotating belt.

Additionally, with any of the embodiments of the resistance based exercise devices, the resilient member support elements can be positioned at any desired location around the secondary exercise device or modality, including in front of a front end portion of the secondary exercise device, along the sides any desired location of the secondary exercise device, or even asked of the aft portion of the secondary exercise device. As shown in FIGS. 26 and 27, the resistance based exercise system 3000 can have a first pair of resilient member support elements 3004*a* positioned laterally of the supplemental exercise device S, and an additional resilient member support element 3004*b* to a forward and or forward of the supplemental exercise device. The resilient member support element 3004*b* can be positioned such that a user standing on a ground surface in front of the supplemental exercise device can use resilient members 3006 supported by the resilient member support element 3004*b* from a ground position without interfering with a user on the supplemental exercise device and/or users on the ground using the laterally positioned resilient exercise support elements 3004*a* from a ground position.

Additionally, the exercise system 3000 can also have additional laterally spaced resistance member support elements 3004*c* positioned to the rear of a space that would be occupied by a user on the supplemental exercise device to provide additional work out or exercise stations around the device. The exercise system 3000 can also have one or more resilient member support elements 3004*d* positioned to the aft of the space that would be occupied by the user of the supplemental exercise device, thereby providing an additional exercise station for any user to use.

Figure 28:
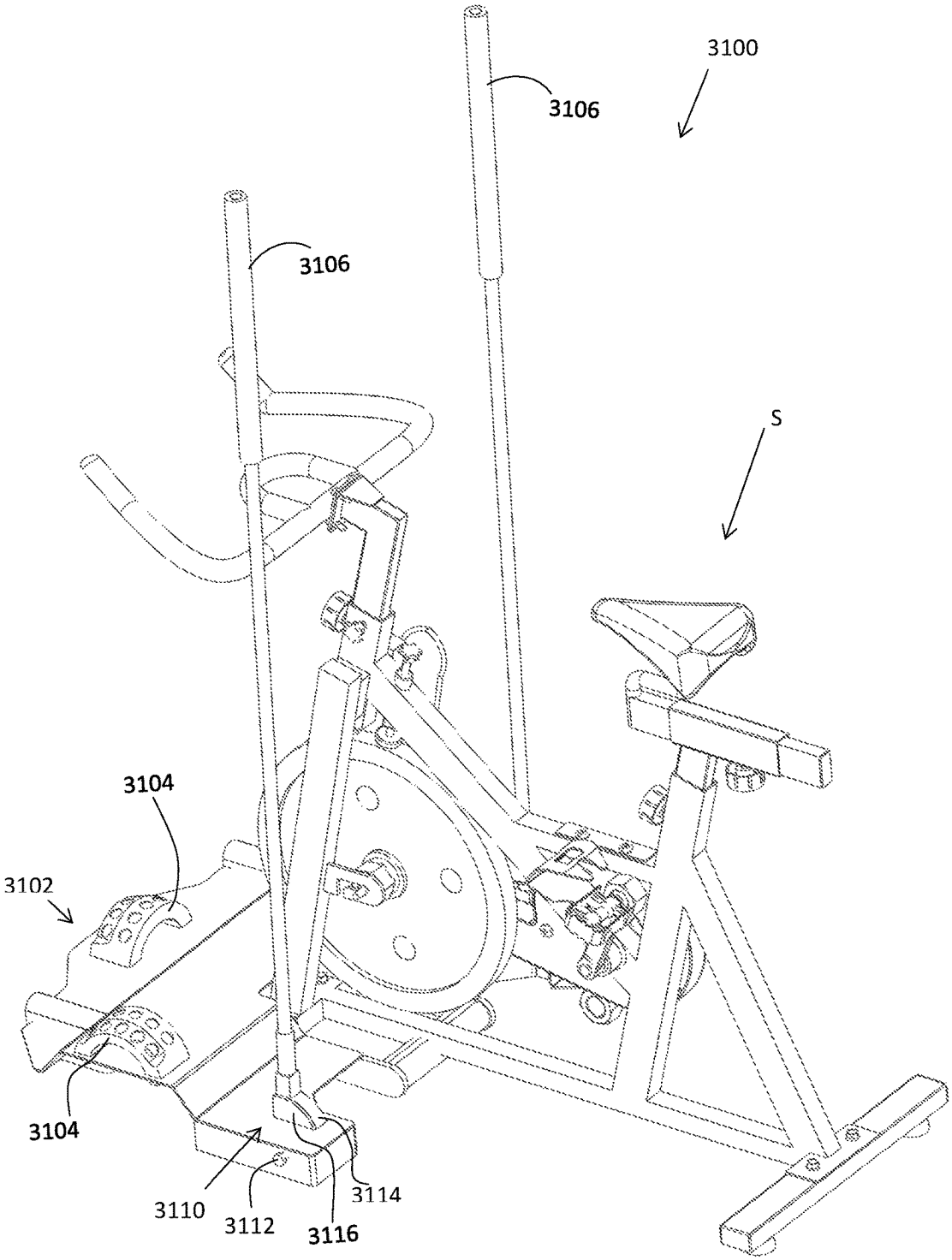
FIG. 28 is a perspective view of another embodiment of a resistance based exercise system having an adjustable resilient member support element, showing the resilient members in a first angular position.
Figure 29:
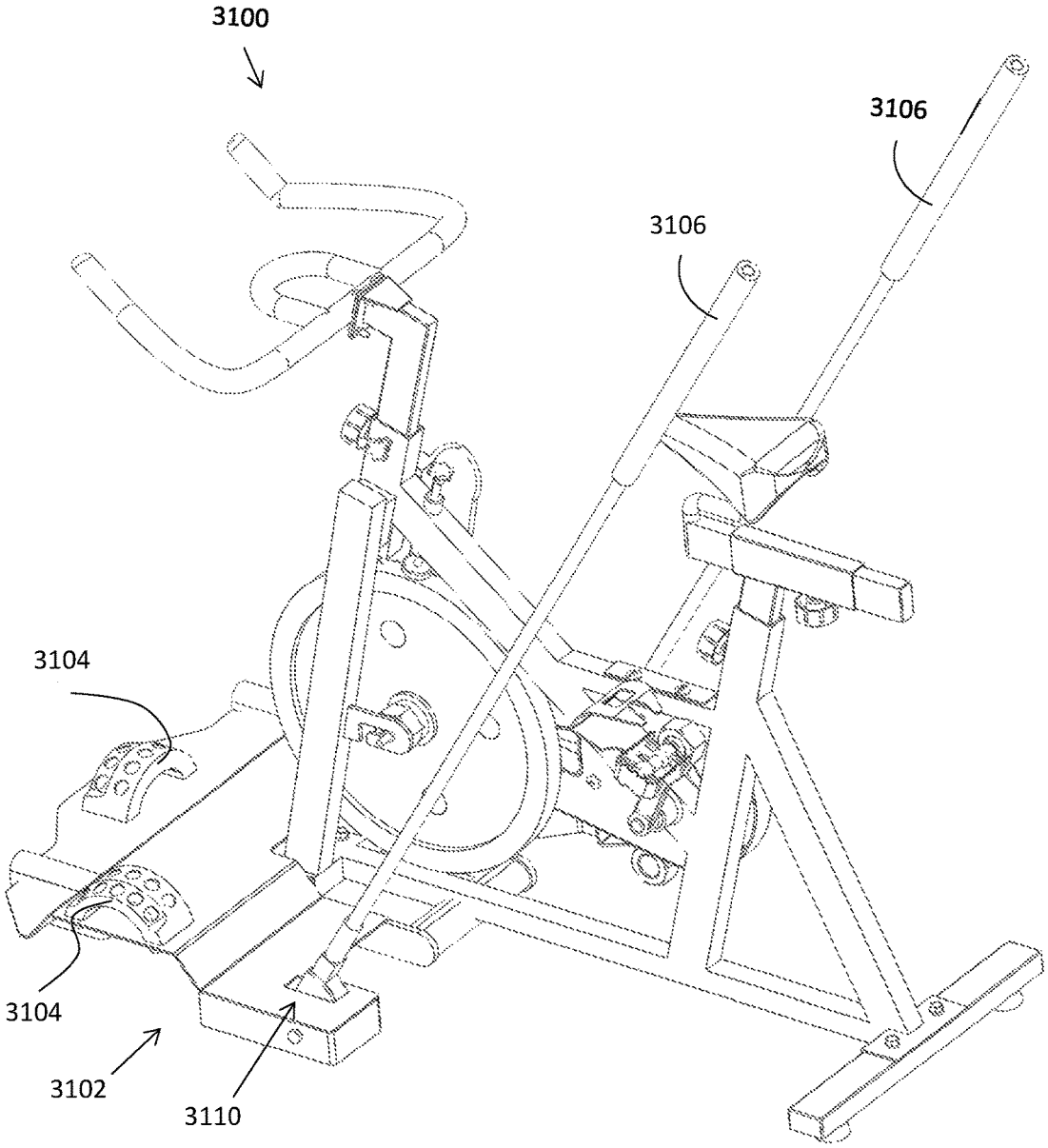
FIG. 29 is a perspective view of the embodiment of the resistance based exercise system shown in FIG. 28, showing the resilient members in a second angular position.
Figure 30:
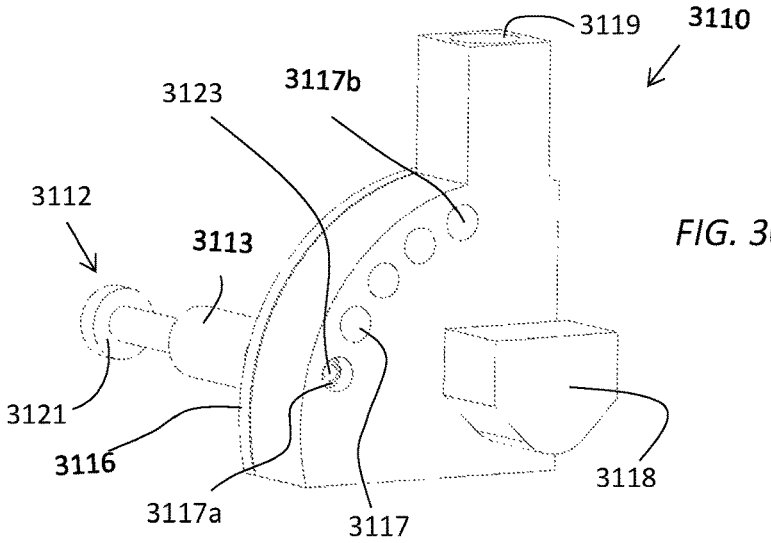
FIG. 30 is a perspective view of the embodiment of the adjustable resilient member support element of the embodiment of the resistance based exercise system shown in FIG. 28, showing the adjustable resilient member support element in a first angular position, similar to that of FIG. 28.
Figure 31:
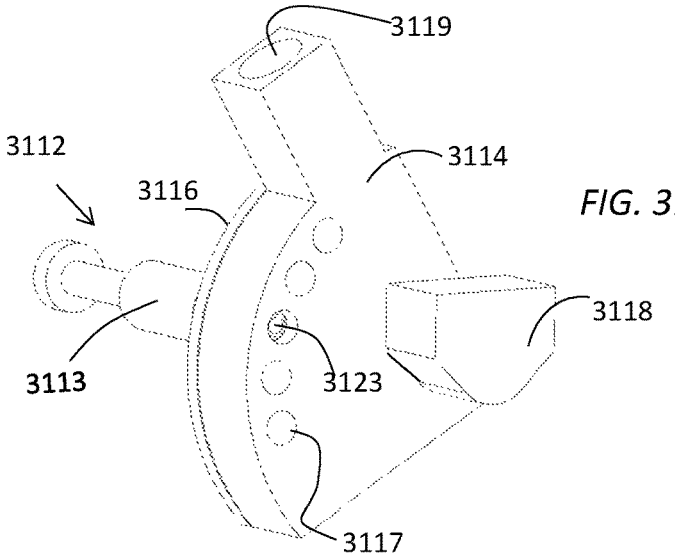
FIG. 31 is a perspective view of the embodiment of the adjustable resilient member support element of the embodiment of the resistance based exercise system shown in FIG. 28, showing the adjustable resilient member support element in a first angular position, similar to that of FIG. 29.
Figure 32:
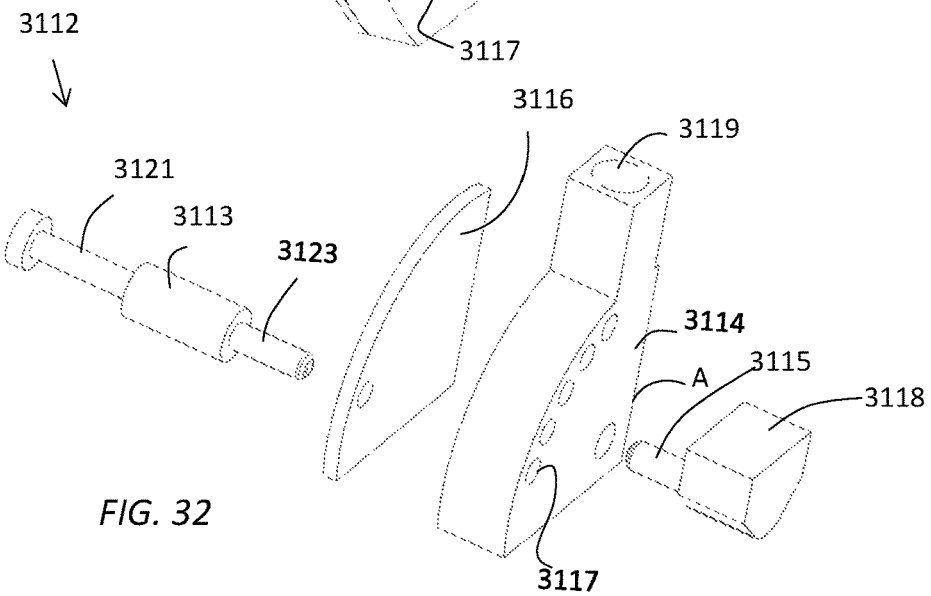
FIG. 32 is an exploded view of the embodiment of the adjustable resilient member support element of the embodiment of the resistance based exercise system shown in FIG. 28.

FIG. 28 is a perspective view of another embodiment of a resistance based exercise system 3100 having an adjustable resilient member support element 3110, showing the resilient members 3106 in a first angular position. FIG. 29 is a perspective view of the embodiment of the resistance based exercise system 3100 shown in FIG. 28, showing the resilient members 3106 in a second angular position. FIG. 30 is a perspective view of the adjustable resilient member support element 3110 showing the adjustable resilient member support element 3110 in a first angular position, similar to that of FIG. 28. FIG. 31 is a perspective view of the adjustable resilient member support element 3110 showing the adjustable resilient member support element 3110 in a second angular position, similar to that of FIG. 29.

The adjustable resilient member support elements 3110 can be structurally supported by the base member 3102 in any desired position. For example, without limitation, the adjustable resilient member support elements 3110 can be positioned laterally from the secondary exercise device S so as to position the resilient members in a position that is outside of the users workspace or movement pattern when using the secondary exercise device. The support body 3114 can be supported about an axle or shaft 3115 supported by a shelf support body 3118. The chef support body 3118 can be coupled with an supported by the base member 3102. Additionally, the pin member 3112 can have a body portion 3113 by the base member 3102 and permit the shaft portion 3123 of the pin member 3112 to advance in an axial direction relative to the body portion 3113 into the openings 3117 of the support body 3114. The body portion 3113 can be coupled with a rigidly supported by the base member such that the handle portion 3121 of the pin member can be accessed by the user to easily to make the adjustment of the angular orientation of the resilient members.

In the illustrated embodiment, the base member 3102 can support a first adjustable resilient member support element 3110 and a second adjustable resilient member support element 3110 in a position that is laterally opposite the first adjustable resilient member support element 3110. Additionally, the base member 3102 can support any desired number of resilient member support elements 3104 and the lateral sides of the device 3100 or forward of the secondary exercise device S, thereby providing multiple workout stations for multiple users and/or for circuit training.

Both of the adjustable resilient member support elements 3110 can be independently adjustable by a user so that a first resilient member can be in a first orientation and the second resilient member can be in a second orientation, the second orientation being the same as or different than the first orientation. A benefit of using the adjustable resilient member support elements 3110 is that a user can easily adjust the angular orientation of the resilient members to suit their needs. To adjust the angular orientation of the resilient members, a user can pull the pin member 3112 to disengage the locking pin from the support body 3114, rotate the support body 3114 about the shaft 3115 until the desired orientation is achieved, and then release the pen member 3112 so that the pin member advances into the opening 3117 corresponding with the desired angular orientation of the support body 3114. The pin member 3112 can be biased toward a second position, the second position being when the pen member is fully inserted into the opening 3117 in the support body 3114. An opening 3119 in the top of the support body can be configured to receive an end portion of a resilient member 3106. A cover member 3116 can be positioned on either or both sides of the body portion 3114 (also referred to as a support body) to seal off access to the openings 3117 thereby preventing potential injury.

By inserting or engaging the engagement pin 3112 into the support body 3114 (which is referred to the second position or second state of the engagement pin), the adjustable resilient member support element 3110 will be in a locked state or configuration (also referred to as the second state). In the locked or second state, the user can exert a force on the resilient members 3106, thereby bending the resilient members and getting resistance for exercise. When the engagement pin 3112 is disengaged from the body portion 3114 (i.e., when the engagement pin 3112 is in a first position), the adjustable resilient member support element 3110 will be in an adjustable or movable state (also referred to as a first state), wherein the user can adjust the angular orientation of the adjustable resilient member support element 3110 and, accordingly, the resilient member.

Some embodiments of the exercise device can be configured such that a resilient member is non-removably coupled with or inserted into the opening 3119 in the support body so that a user cannot remove the resilient member from the support body or from the exercise device. This could prevent loss or theft of the resilient members, and make it easier for a user to use the device. However, it may be more challenging to adjust the resistance level of the resilient member if the resilient member cannot be removed. However, increasing the angle can result in preloading the resilient member such that an additional force is achieved due to the progressively increasing resistance of the resilient members.

With reference to FIG. 30, the openings 3117 can be separated by any desired angle, the angle being defined by a line that goes through the axis of rotation A of the support body 3114 and extends through a center of the opening 3117. For example, in some embodiments, the holes 3117 can be sized and arranged such that and angular orientation of a resilient member 3106 supported by the support body can change by approximately 15° from one hole to the next adjacent hole, or between approximately 10° and approximately 20° from one hole to the next adjacent hole. In the embodiment where the angular orientation changes from one hole to the next by approximately 15°, positioning five holes 3117 in the support body will permit a total adjustability range of approximately 45° from the first hole 3117*a* to the last hole 3117*b*.

Figure 33:
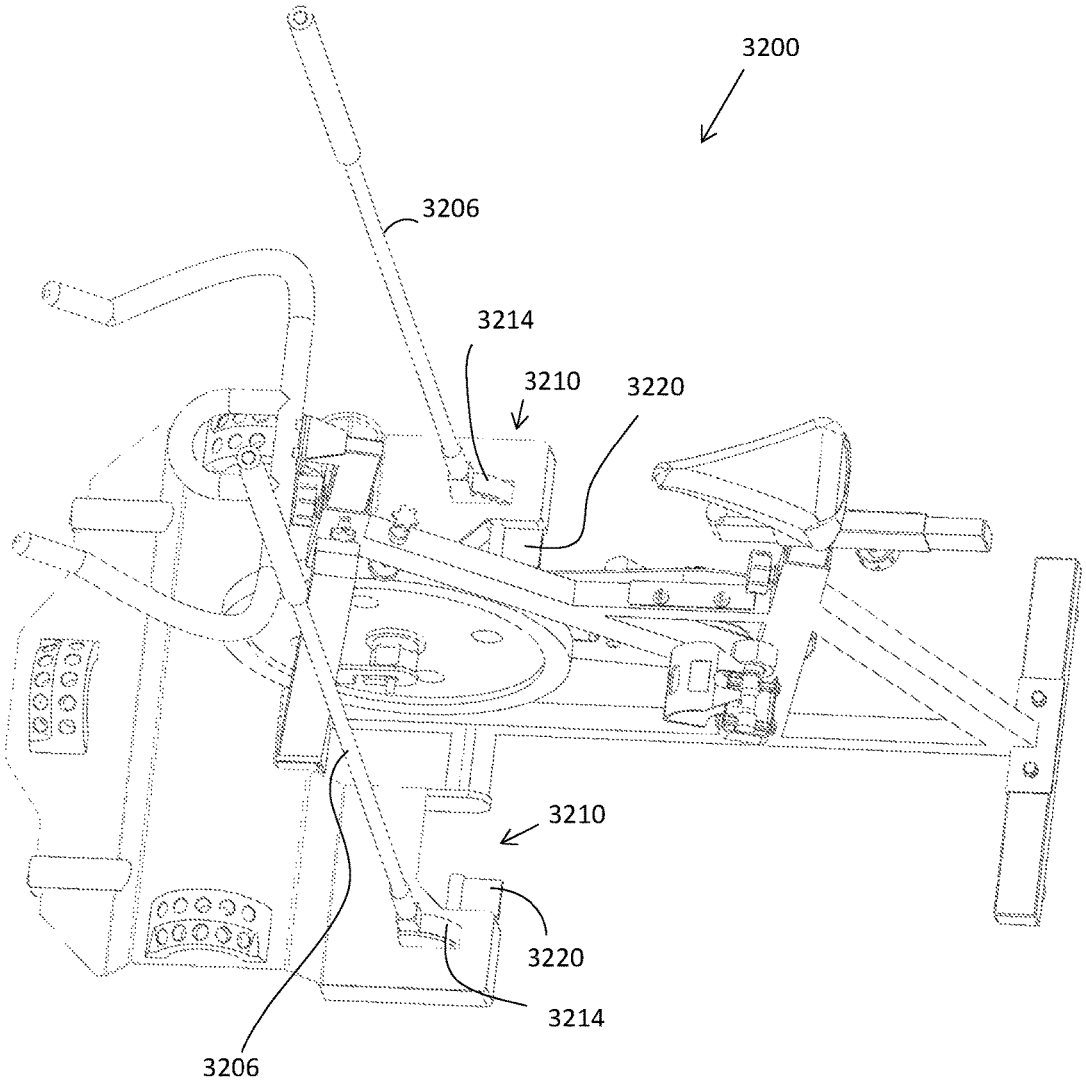
FIG. 33 is a perspective view of another embodiment of a resistance based exercise system having an adjustable resilient member support element.

Any embodiments disclosed herein can have one or more adjustable resilient member support elements 3110 in place of or in addition to any of the resilient member support elements disclosed herein. Additionally, any of the embodiments disclosed herein can have any desired form of engagement pen in place of the 10 member 3112. For example and without limitation, with reference to FIG. 33, disengagement of the adjustable resilient member support element 3210 can be achieved by depressing a tab or panel member 3220 that can disengage the pin member (not shown) from the body portion 3214. In this configuration, a user can use his or her own foot to easily release the locking mechanism and allow the free rotation of the adjustable resilient member support element 3214 to the desired angular orientation.

When the adjustable resilient member support element 3214 and, therefore, the resilient member 3206, are in the desired location, the user can simply release the pedal member 32202 cause the engagement pin member to reengage one of the openings or other features formed in the body portion 3214, thereby securing the adjustable resilient member support element 3210 in the desired angular orientation. When the adjustable resilient member support element 3210 is in the locked state or configuration, a user can bend the resilient members and perform the exercises on the device 3200.

In any embodiments disclosed herein, the adjustable resilient member support elements can have recesses, channels, teeth, or other features alternative to or in addition to the openings for engagement with an engagement pen or engagement member. For example, a gear system or channels formed on a peripheral arcuate surface of the body portion of the adjustable resilient member support elements can be used to engage and disengage or change from a first day to a second state the adjustable resilient member support elements. For example and without limitation, in some embodiments, engagement and disengagement of the adjustable resilient member support element can be achieved by sandwiching or compressing plates having engagement elements or mechanisms, such as teeth, recesses, channels, protrusions, or other features, about a planar surface of the support body of the adjustable resilient member support element.

Additionally, in any embodiments disclosed herein, the adjustable resilient member support element can be configured such that a user can disengage the engagement mechanism or pin of the adjustable resilient member support element by pushing axially downward on a resilient member supported by the adjustable resilient member support element. For example, in any embodiments disclosed herein, the engagement mechanism or locking mechanism of the adjustable resilient member support element can have teeth or can have an engagement pin that can be biased toward an engaged position when the resilient member is relaxed. A spring mechanism can be used to bias the engagement pin toward the relaxed position. Pushing down on the resilient member can overcome the bias and cause the engagement mechanism to disengage, thereby allowing the adjustable resilient member support element to be freely rotated about a predefined range of motion. When a user positions the resilient member in the desired angular orientation, the resilient member can be relaxed, thereby allowing the biasing member or spring member to return the engagement pen to the locked or engaged position, thereby fixing the angular orientation of the adjustable resilient member support element.

In some embodiments, this can also be achieved by depressing the body portion or body member of the adjustable resilient member support element such that tabs, teeth, and engagement pin, or other locking mechanisms (i.e., engagement elements) are no longer engaged with the body portion or body member. For example, body portion or body member can have a narrowed portion thereof that, when the body portion or body member is depressed, the narrow portion is permitted to rotate or advance past the engagement pin or engagement teeth of the adjustable resilient member support element. The body member can then be rotated to the desired position with the body portion depressed by the downward force of the resilient member, and then the body portion can reengage with the engagement element of the adjustable resilient member support element to fix or lock the location or angular orientation of the resilient member.

Additionally, in any embodiments disclosed herein, and electrically powered actuator (which can be, but is not required to be a linear actuator) can be used to move the engagement pin from a first state or position in which the pin is disengaged from the body portion to a second state or position in which the engagement pin is engaged with the body portion of the adjustable resilient member support element. The linear actuator can be controlled either by an interface on the base member of the exercise device, or by buttons or controls on a user interface for monitor of the secondary exercise device. In this configuration, it will be much easier for a user to adjust the angular orientation of the resilient members. A user can simply deactivate the engagement pin by pressing a button, adjusting the angular orientation of the resilient members, and then re-engaging the engagement pin by pressing either the same or different button. The buttons can control the actuator to engage and disengage the body portion or support portion of the adjustable resilient member support element. In any embodiments disclosed herein, the actuator can be wirelessly or connected by wires to the controller.

Furthermore, in any embodiments disclosed herein, a screw drive or other adjustable system can be used to adjust and angular orientation of the adjustable resilient member support element. In this configuration, with a screw drive or other actuator coupled with the support body, such as support body 3114, a user can adjust and angular orientation of the adjustable resilient member support elements automatically and without physically moving the adjustable resilient member support elements to the desired angular orientation. For example, the user can turn a dial or activate a button or other feature to activate the linear actuator or screw drive to adjust the adjustable resilient member support element to the desired angular orientation relative to the user. This can greatly simplify and streamline the setup of the resilient members for any user, particularly for users who may have difficulty physically engaging and disengaging the engagement pin or other components of the adjustable resilient member support elements.

Additionally, in some embodiments, a gear drive system can be used to adjust and angular orientation of the adjustable resilient member support elements wherein a motor having a drive gear thereon engages with teeth on the support body, such as support body 3114, or a gear coupled with the support body to turn and therefore adjust the orientation of the support body Again, any of the two or more adjustable resilient member support elements can be independently adjustable so that the angular orientation of the resilient members can be individually adjusted.

With any of the embodiments disclosed herein, one or more sensors can be added to one or more of the resilient members to allow the system to track one or more parameters related to the movement of the resilient members. For example, sensors can be attached to or integrated into the resilient members to provide measurement data and/or feedback regarding the position, speed, acceleration, direction and other parameters related to the movement of the resilient members (collectively referred to herein as measurement information). The sensors can be positioned and configured such that the measurement information can be gathered for the handle portion of the resilient members.

In some embodiments, the sensors can be positioned and configured such that the measurement information is gathered for the end portion of the resilient member. The sensors can be based on or comprise the technology and components of currently available sensors, including the 3 axis motion processing solutions, 6 axis motion tracking solutions, 9 axis motion tracking solutions and any combination of accelerometer and/or gyroscopic motion sensors available from Invensense and/or other developers or manufacturers of motion or position sensing equipment.

A three axis accelerometer plus gyroscope can be used to gather the motion data. For example, a SparkFun™ MPU-6050 3-axis accelerometer with a MEMS 3-axis gyroscope with an onboard digital motion processor can be used. A microcontroller, such as the Arduino™ Pro Mini 328, can be connected to the SparkFun accelerometer/gyroscope, and then to a wireless communicator (which can be based on current wireless or Bluetooth technology) to feed the data to an external source, such as a laptop, smartphone, tablet, personal computer, or otherwise. A power supply, such as a lithium ion battery pack, can be used to provide power to these components. These components can be mounted together in a removable carrier that can be removably attached or coupled with a resilient member to track the movement of a user's hands and arms when bending the resilient members. A software program can be developed to process the data gathered by the sensor assembly such that a user can have real-time information about the positioned of his or her hands during the exercise.

This information can be particularly helpful when instructing a user to move the resilient members in his or her hands through a particular movement pattern. For example, in skills training used for improving cognitive capabilities in executive function, as well as having other neurological benefits, a user performs a challenging program of movements with his or her hands. Being able to follow targets on a computer screen for example which trace out and represent hand movements, a user can determine how accurately they are following such targets if they can see the position of their own hands on the computer screen relative to the target movement. For example, if a right hand is doing up pressing and pulling motion forward and tore the body in a reciprocating fashion, a target movement icon on the screen can move up and down in a linear fashion. A second dot or icon on the computer screen representing the actual position of the user's hand based on the data and information provided by the sensor assembly, can provide visual feedback to the user so that the user can determine how closely they are tracking the target movement icon.

A user can have a pair of sensors, one on each arm or hand or, located on each of the two resilient members that are being used, so that data and information regarding the movement of the left and the right hands can be gathered while the user is performing the exercises and even compared with left and right appendage targets on the computer screen. This can be a very beneficial tool for the user performing different exercises.

The movements can comprise asymmetric movements between the left and right appendages of the body, to create additional cognitive challenges. The cognitive and neurological benefits of goal-based skill training can be enhanced if such skill training exercises are performed during aerobic exercise. Again, the sensors can be attached to the resilient members at any desired position on the resilient members, or can be attached to a user's wrist or hands.

The resilient member supports can have any of the features, shapes, components, materials, or other details of any of the embodiments of the resilient member supports in this disclosure or incorporated by reference herein. Similarly, the resilient members can have any of the features, shapes, components, materials, or other details of any of the embodiments of the resilient members disclosed in this disclosure or incorporated by reference herein.

The resilient member supports which can be, but are not required to be, arc shaped supports, can either be supported by the second exercise device or a portion thereof, or can be supported independently of the second exercise device on a structure that can support or be coupled with the second exercise device. In any embodiments disclosed herein, the support members used to support the end portion of one or more resilient members can be supported by a base member that is independently moveable with respect to the secondary exercise device or components, or which is coupled with or part of the secondary exercise device or components.

In any embodiments disclosed herein, the resilient member support elements can be made from high-strength aluminum, including 6061-T6 aluminum with a Type III hard anodize for additional strength and durability. Additionally, any of the resilient members can comprise poultry did fiberglass, including polyester, polyvinyl, or epoxy based pultruded fiberglass having a large number of continuous strands of fiberglass extending along the length or a substantial portion of the length of the resilient members.

Other sizes, shapes, and configurations of the base, resilient members, base interface members, connection interfaces, or any other components or combination of components described herein or known in the art or to one of ordinary skill in the art can be used with the exercise device of this disclosure. For example, the components and assemblies described in U.S. Pat. No. 8,500,612 and U.S. Pat. No. 7,704,199 can be used to practice the exercise device of this disclosure. The entirety of the foregoing patents are hereby incorporated by reference herein and made a part of the present specification as if fully set forth herein.

Although the embodiments in this disclosure have been disclosed in the context of a certain preferred embodiments and examples, it will be understood by those skilled in the art that the embodiments of the present disclosure extend beyond the specifically disclosed embodiments to other alternative embodiments and/or uses of the embodiments of the present disclosure and obvious modifications and equivalents thereof. In addition, while a number of variations of the embodiments of the present disclosure have been shown and described in detail, other modifications, which are within the scope of the embodiments of the present disclosure, will be readily apparent to those of skill in the art based upon this disclosure. It is also contemplated that various combinations or subcombinations of the specific features and aspects of the embodiments may be made and still fall within the scope of the embodiments of the present disclosure. Accordingly, it should be understood that various features and aspects of the disclosed embodiments can be combined with or substituted for one another in order to form varying modes of the disclosed embodiments of the present disclosure. Thus, it is intended that the scope of this disclosure herein disclosed should not be limited by the particular disclosed embodiments described above.

What is claimed is:

1. An exercise device, comprising:

a first resilient member support element, a second resilient member support element, and a third resilient member support element supported by a base member;

a first set of connection interfaces supported by the first resilient member support element, the first set of connection interfaces comprising a first connection interface having a first axial centerline and positioned at a first angular orientation and a second connection interface having a second axial centerline and positioned at a second angular orientation that is different than the first angular orientation;

first and second independently deflectable resilient members respectively supported by the first resilient member support element and the second resilient member support element, each configured to produce a resistance force when a user exerts a force thereon so as to deflect at least a portion of each resilient member from a longitudinal axis of a relaxed position of each resilient member; and a secondary exercise device configured to provide an additional mode of exercise separate and independent from the resilient members, the secondary exercise device being usable independent of and/or simultaneously with the resilient members;

wherein:

the first resilient member support element is positioned adjacent to the ground level to a lateral side of the secondary exercise device;

the second resilient member support element is positioned adjacent to the ground level to an opposite side of the secondary exercise device, the second resilient member support element being approximately symmetrically positioned about a plane passing through a longitudinal center of the secondary exercise device relative to the first resilient member support element;

the first and second resilient member support elements are laterally positioned relative to the secondary exercise device at a width sufficient to ensure that the use of the secondary exercise device is not obstructed by the use of the first or second resilient members;

the third resilient member support element is positioned forward of a front end portion of the secondary exercise device adjacent to the ground level;

each resilient member support element is configured to provide an angularly adjustable support for each resilient member so as to support each resilient member in a cantilever disposition; and the secondary exercise device is an exercise bike, an exercise stepping machine, or an elliptical machine.

2. The exercise device of claim 1, wherein the base member is formed integrally with a support structure of the secondary exercise device.

3. The exercise device of claim 1, wherein the secondary exercise device is an exercise bike.

4. The exercise device of claim 1, wherein adjacent to the ground level means within approximately 3 inches of the ground surface.

5. The exercise device of claim 1, wherein adjacent to the ground level means within approximately 5 inches of the ground surface.

6. A method of exercising using the exercise device of claim 1, comprising exercising a portion of a user's body by deflecting the first resilient member and/or the second resilient member while simultaneously engaging in a secondary exercise mode on the secondary exercise device.

7. The method of claim 6, further comprising exercising a portion of a user's body by deflecting a resilient member supported by the third resilient member support element while standing adjacent to the secondary exercise device.

8. The method of claim 6, wherein the secondary exercise device is an exercise bicycle and the secondary exercise mode comprises pedaling.

9. The method of claim 6, further comprising terminating the secondary exercise mode, moving out of contact with secondary exercise device and engaging one or more of the first and second resilient members.

10. The exercise device of claim 1, further comprising a third set of connection interfaces supported by the third resilient member support element, wherein each of the first, second, and third sets of connection interfaces comprises a plurality of holes, wherein an end portion of each of the resilient members is removably supportable in each of the plurality of holes, and wherein each hole in a respective set of connection interfaces is at a different angular orientation so as to support the resilient members at a plurality of different angular orientations.

11. The exercise device of claim 1, wherein the base member is either attached to or is part of a support structure of the secondary exercise device.

12. The exercise device of claim 1, wherein at least one of the first, second, and third resilient member support elements is movably adjustable, wherein changing an angular orientation of the adjustable resilient member support element relative to the base member will change an angular orientation of a resilient member supported by the adjustable resilient member support element.

13. The exercise device of claim 1, further comprising one or more wheels supported at a front portion of the exercise device for moving the exercise device and the secondary exercise device.

14. An exercise device, comprising:

a base member attached to a lower portion of a frame of a secondary exercise device such that the base member lies against or adjacent to a ground surface;

a first resilient member support element and a second resilient member support element supported by a base member, with the first resilient member support element being on one side of the secondary exercise device and the second resilient member support element being on a second side of the secondary exercise, the second side being opposite the first side;

a third resilient member support element supported by the base member, the third resilient member support element being positioned adjacent to a front end portion of the secondary exercise device adjacent to the ground level;

a first set of connection interfaces supported by the first resilient member support element, the first set of connection interfaces comprising a first connection interface having a first axial centerline and positioned at a first angular orientation and a second connection interface having a second axial centerline and positioned at a second angular orientation that is different than the first angular orientation; and first and second independently deflectable resilient members respectively supported by the first resilient member support element and the second resilient member support element, each configured to produce a resistance force when a user exerts a force thereon so as to deflect at least a portion of each resilient member from a longitudinal axis of a relaxed position of each resilient member;

wherein:

the first and second resilient member support elements are laterally positioned relative to the secondary exercise device at a width sufficient to ensure that the use of the secondary exercise device is not obstructed by the use of the first resilient member or second resilient member;

each resilient member support element is configured to provide an angularly adjustable support for each resilient member so as to support each resilient member in a cantilever disposition; and the secondary exercise device is configured to provide an additional mode of exercise separate and independent from the resilient members, the secondary exercise device being usable independent of and/or simultaneously with the resilient members.

15. The exercise device of claim 14, wherein the exercise device is configured to be attachable to the frame of the secondary exercise device without requiring any modification to the frame of the secondary exercise device, so as to retrofit the secondary exercise device.

16. The exercise device of claim 14, wherein the secondary exercise device is an exercise stepping machine or an elliptical machine.

17. The exercise device of claim 14, wherein the base member extends over a portion of the frame of the secondary exercise device.

18. A method of exercising using the exercise device of claim 14, comprising:

exercising a portion of a user's body by deflecting the first and/or the second resilient member supported by the first and/or the second resilient member support element while simultaneously engaging in a secondary exercise mode on the secondary exercise device;

wherein:

the secondary exercise mode comprises one or more of walking, jogging, running, pedaling, and exercising on an elliptical machine or step machine; and the base member is positioned approximately adjacent to a ground level.

19. An exercise device, comprising:

a base member attached to a lower portion of a frame of a secondary exercise device such that the base member lies against or adjacent to a ground surface;

a first resilient member support element and a second resilient member support element supported by the base member, with the first resilient member support element being on one side of the secondary exercise device and the second resilient member support element being on a second side of the secondary exercise, the second side being opposite the first side;

a third resilient member support element supported by the base member, the third resilient member support element being positioned adjacent to a front end portion of the secondary exercise device adjacent to the ground level;

a first set of connection interfaces supported by the first resilient member support element, the first set of connection interfaces comprising a first connection interface having a first axial centerline and positioned at a first angular orientation and a second connection interface having a second axial centerline and positioned at a second angular orientation that is different than the first angular orientation; and first and second independently deflectable resilient members respectively supported by the first resilient member support element and the second resilient member support element, each configured to produce a resistance force when a user exerts a force thereon so as to deflect at least a portion of each resilient member from a longitudinal axis of a relaxed position of each resilient member;

wherein:

the first and second resilient member support elements are laterally positioned relative to the secondary exercise device at a width sufficient to ensure that the use of the secondary exercise device is not obstructed by the use of the first resilient member or second resilient member;

each resilient member support element is configured to provide an angularly adjustable support for each resilient member so as to support each resilient member in a cantilever disposition;

the secondary exercise device is configured to provide an additional mode of exercise separate and independent from the resilient members, the secondary exercise device being usable independent of and/or simultaneously with the resilient members; and the secondary exercise device is an exercise bike.

20. The exercise device of claim 19, wherein the base member is either attached to or is part of a support structure of the exercise bike.

* * * * *